US009703244B2

(12) United States Patent
Iwata et al.

(10) Patent No.: US 9,703,244 B2
(45) Date of Patent: Jul. 11, 2017

(54) IMAGE FORMING APPARATUS TO CORRECT A DRIVING SIGNAL FOR DRIVING A LIGHT SOURCE

(71) Applicants: Muneaki Iwata, Kanagawa (JP); Masaaki Ishida, Kanagawa (JP); Atsufumi Omori, Kanagawa (JP); Naoto Watanabe, Kanagawa (JP); Hayato Fujita, Kanagawa (JP)

(72) Inventors: Muneaki Iwata, Kanagawa (JP); Masaaki Ishida, Kanagawa (JP); Atsufumi Omori, Kanagawa (JP); Naoto Watanabe, Kanagawa (JP); Hayato Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/067,660

(22) Filed: Mar. 11, 2016

(65) Prior Publication Data

US 2016/0274521 A1 Sep. 22, 2016

(30) Foreign Application Priority Data

Mar. 17, 2015 (JP) ..... 2015-053803

(51) Int. Cl.
*G03G 15/00* (2006.01)
*G03G 15/043* (2006.01)
*G03G 15/04* (2006.01)

(52) U.S. Cl.
CPC ..... *G03G 15/5041* (2013.01); *G03G 15/043* (2013.01); *G03G 15/04072* (2013.01);
(Continued)

(58) Field of Classification Search
CPC ..... G03G 15/5041; G03G 15/043
(Continued)

(56) References Cited

U.S. PATENT DOCUMENTS 6,498,617 B1 12/2002 Ishida et al.
7,382,387 B2 * 6/2008 Ichikawa ..... G03G 15/0131 347/131

(Continued)

FOREIGN PATENT DOCUMENTS

JP 2005-007697 1/2005
JP 2008-145559 6/2008

(Continued)

OTHER PUBLICATIONS

U.S. Appl. No. 14/948,867, filed Nov. 23, 2015.

*Primary Examiner* — Hoang Ngo
(74) *Attorney, Agent, or Firm* — Oblon, McClelland, Maier & Neustadt, L.L.P.

(57) ABSTRACT

An image forming apparatus includes: a photoconductor drum; an optical scanning device that drives a light source to scan a surface of the photoconductor drum and form a latent image on the surface; a developing device that develops the latent image; and a density detector to detect density variation of an image in a rotation direction of the photoconductor drum, the image being developed by the developing device. The optical scanning device includes a processing device that is capable of correcting a driving signal for driving the light source on a basis of an output signal of the density detector to adjust at least either one of a correction period and a correction strength of correction data for the driving signal for a rotation period of the photoconductor drum.

16 Claims, 23 Drawing Sheets

(52) U.S. Cl.
CPC . *G03G 15/5054* (2013.01); *G03G 2215/0132* (2013.01); *G03G 2215/0164* (2013.01)

(58) Field of Classification Search
USPC ..... 399/49, 51
See application file for complete search history.

(56) References Cited

U.S. PATENT DOCUMENTS

| | | | |
|---|---|---|---|
| 7,697,867 | B2 | 4/2010 | Ehara et al. |
| 8,237,760 | B2 | 8/2012 | Nihei et al. |
| 8,310,513 | B2 | 11/2012 | Nihei et al. |
| 8,310,516 | B2 | 11/2012 | Tanabe et al. |
| 8,610,971 | B2 | 12/2013 | Omori et al. |
| 8,687,036 | B2 | 4/2014 | Ishida et al. |
| 9,035,988 | B2 | 5/2015 | Nihei et al. |
| 2003/0025785 | A1 | 2/2003 | Nihei et al. |
| 2003/0067533 | A1 | 4/2003 | Omori et al. |
| 2003/0156184 | A1 | 8/2003 | Suzuki et al. |
| 2004/0125199 | A1 | 7/2004 | Omori et al. |
| 2005/0243163 | A1 | 11/2005 | Ozasa et al. |
| 2006/0285186 | A1 | 12/2006 | Ishida et al. |
| 2007/0030548 | A1 | 2/2007 | Nihei et al. |
| 2007/0091163 | A1 | 4/2007 | Omori et al. |
| 2007/0132828 | A1 | 6/2007 | Ishida et al. |
| 2007/0242127 | A1 | 10/2007 | Omori et al. |
| 2008/0088893 | A1 | 4/2008 | Ishida et al. |
| 2008/0123160 | A1 | 5/2008 | Omori et al. |
| 2008/0218813 | A1 | 9/2008 | Tanabe et al. |
| 2008/0225106 | A1 | 9/2008 | Omori et al. |
| 2008/0239336 | A1 | 10/2008 | Tanabe et al. |
| 2008/0267663 | A1 | 10/2008 | Ichii et al. |
| 2009/0167837 | A1 | 7/2009 | Ishida et al. |
| 2009/0174915 | A1 | 7/2009 | Nihei et al. |
| 2009/0195635 | A1 | 8/2009 | Ishida et al. |
| 2009/0231656 | A1 | 9/2009 | Suzuki et al. |
| 2009/0303451 | A1 | 12/2009 | Miyake et al. |
| 2010/0119262 | A1 | 5/2010 | Omori et al. |
| 2011/0199657 | A1 | 8/2011 | Ishida et al. |
| 2011/0228037 | A1 | 9/2011 | Omori et al. |
| 2012/0099165 | A1 | 4/2012 | Omori et al. |
| 2012/0155899 | A1 | 6/2012 | Watanabe et al. |
| 2012/0189328 | A1 | 7/2012 | Suzuki et al. |
| 2012/0293783 | A1 | 11/2012 | Ishida et al. |
| 2013/0302052 | A1 | 11/2013 | Iwata et al. |
| 2014/0139603 | A1 | 5/2014 | Fujita et al. |
| 2014/0139605 | A1 | 5/2014 | Fujita et al. |
| 2014/0176656 | A1 | 6/2014 | Omori et al. |
| 2014/0268186 | A1 | 9/2014 | Iwata et al. |
| 2014/0327938 | A1 | 11/2014 | Ishida et al. |
| 2014/0333940 | A1 | 11/2014 | Iwata et al. |
| 2014/0333941 | A1 | 11/2014 | Iwata et al. |
| 2015/0125171 | A1 | 5/2015 | Iwata et al. |
| 2015/0156373 | A1 | 6/2015 | Fujita et al. |
| 2015/0180200 | A1 | 6/2015 | Fujita et al. |
| 2015/0251442 | A1 | 9/2015 | Ishida et al. |
| 2015/0324671 | A1 | 11/2015 | Iwata et al. |
| 2015/0350491 | A1 | 12/2015 | Iwata et al. |
| 2016/0012322 | A1 | 1/2016 | Iwata et al. |

FOREIGN PATENT DOCUMENTS

| | | |
|---|---|---|
| JP | 2010-208024 | 9/2010 |
| JP | 2012-088522 | 5/2012 |

* cited by examiner

FIG.25

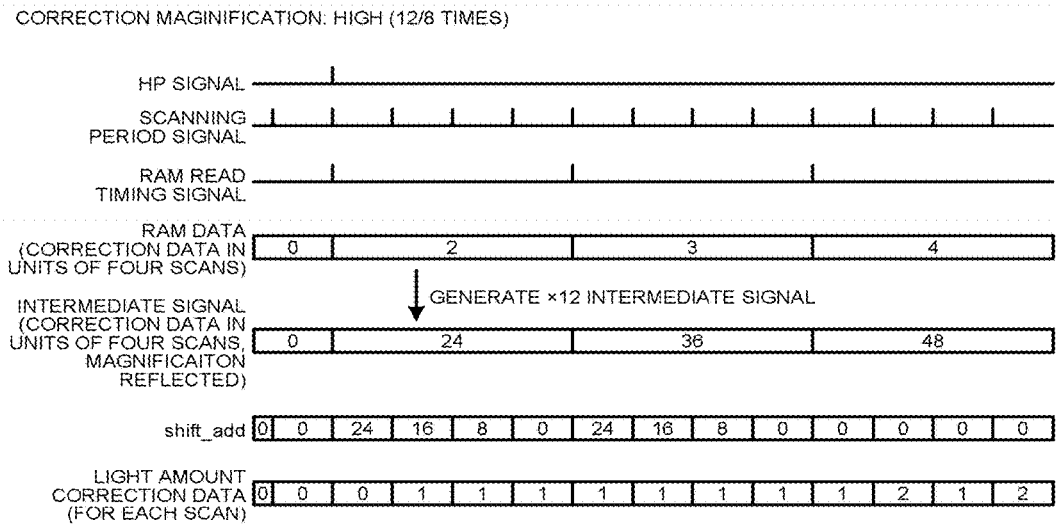

(1) GENERATE INTERMEDIATE VALUES BY MULTIPLYING RAM DATA BY MAGNIFICATION. ADD UP INTERMEDIATE VALUES ON EACH SCAN. (CORRESPONDING TO SIGNAL shift_add)

(2) IF shift_add EXCEEDS 32, MAKE ONE STEP OF CHANGE.
IF shift_add EXCEEDS 64, MAKE TWO STEPS OF CHANGE.
(IF UPPER TWO BITS OF shift_add, AS 7-BIT SIGNAL, IS 01, ONE STEP. IF 11, TWO STEPS)
(IF SUM REACHES OR EXCEEDS 32 OR 64, SUBSTITUTE DIFFERENCE FROM 32 OR 64 INTO shift_add)

FIG.27

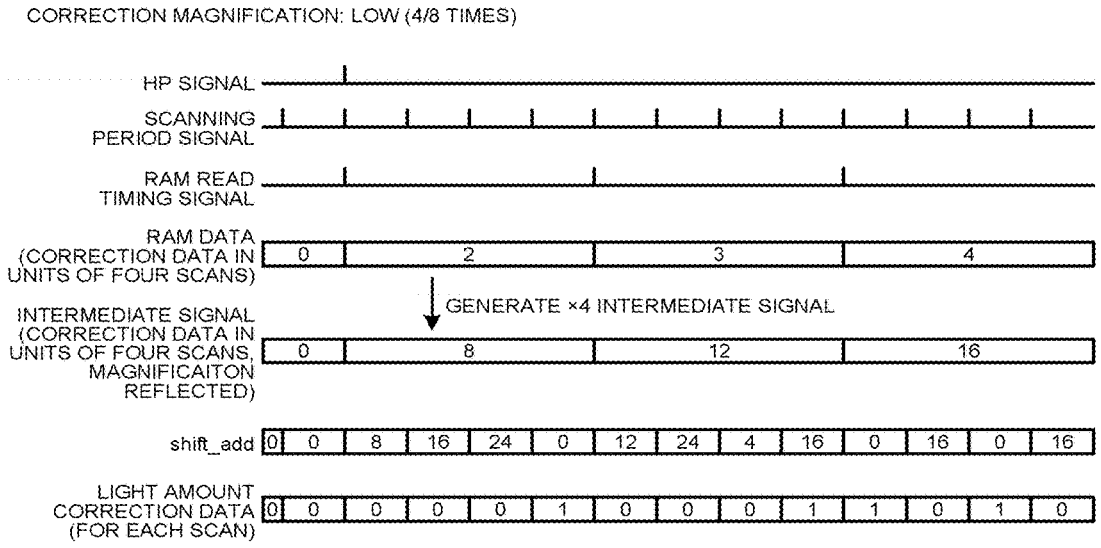

(1) GENERATE INTERMEDIATE VALUES BY MULTIPLYING RAM DATA BY MAGNIFICATION. ADD UP INTERMEDIATE VALUES ON EACH SCAN. (CORRESPONDING TO SIGNAL shift_add)

(2) IF shift_add EXCEEDS 32, MAKE ONE STEP OF CHANGE.
IF shift_add EXCEEDS 64, MAKE TWO STEPS OF CHANGE.
(IF UPPER TWO BITS OF shift_add, AS 7-BIT SIGNAL, IS 01, ONE STEP. IF 11, TWO STEPS)
(IF SUM REACHES OR EXCEEDS 32 OR 64, SUBSTITUTE DIFFERENCE FROM 32 OR 64 INTO shift_add)

IMAGE FORMING APPARATUS TO CORRECT A DRIVING SIGNAL FOR DRIVING A LIGHT SOURCE

CROSS-REFERENCE TO RELATED APPLICATIONS

The present application claims priority to and incorporates by reference the entire contents of Japanese Patent Application No. 2015-053803 filed in Japan on Mar. 17, 2015.

BACKGROUND OF THE INVENTION

1. Field of the Invention

The present invention relates to an image forming apparatus and an image forming method, and more particularly to an image forming apparatus and an image forming method for forming an image by exposing a surface of a photoconductor drum.

2. Description of the Related Art

Image forming apparatuses that form an image by exposing a surface of a photoconductor drum or drums have been actively developed in recent years.

For example, Japanese Patent Application Laid-Open No. 2005-007697, Japanese Patent Application Laid-Open No. 2010-208024 and Japanese Patent Application Laid-Open No. 2012-088522 disclose image forming apparatuses that suppress density unevenness of an image in a rotation direction of a photoconductor drum.

According to the conventional image forming apparatuses discussed in Japanese Patent Application Laid-Open No. 2005-007697, Japanese Patent Application Laid-Open No. 2010-208024 and Japanese Patent Application Laid-Open No. 2012-088522 and the like, it has been difficult to stably suppress density unevenness of an image in the rotation direction of the photoconductor drum while suppressing a drop in productivity.

SUMMARY OF THE INVENTION

It is an object of the present invention to at least partially solve the problems in the conventional technology.

An image forming apparatus includes: a photoconductor drum; an optical scanning device that drives a light source to scan a surface of the photoconductor drum and form a latent image on the surface; a developing device that develops the latent image; and a density detector to detect density variation of an image in a rotation direction of the photoconductor drum, the image being developed by the developing device. The optical scanning device includes a processing device that is capable of correcting a driving signal for driving the light source on a basis of an output signal of the density detector to adjust at least either one of a correction period and a correction strength of correction data for the driving signal for a rotation period of the photoconductor drum.

An image forming method includes: driving a light source to expose a surface of a photoconductor drum and form a latent image on the surface; developing the latent image; detecting density variation of an image in a rotation direction of the photoconductor drum, the image being developed at the developing; correcting a driving signal on a basis of a detection result at the detecting of the density variation; storing correction data for the driving signal for a rotation period of the photoconductor drum; and adjusting at least either one of a correction period and a correction strength of the correction data.

An image forming apparatus is for driving a light source to expose a photoconductor drum and form an image. The image forming apparatus includes: a density detector to detect density variation of the image in a rotation direction of the photoconductor drum; and a processing device that is capable of correcting a driving signal for driving the light source on a basis of an output signal of the density detector to adjust at least either one of a correction period and a correction strength of correction data for a rotation period of the photoconductor drum.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 25 is a diagram (part 2) for describing the light amount correction strength adjustment processing;

FIG. 27 is a diagram (part 4) for describing the light amount correction strength adjustment processing;

DETAILED DESCRIPTION OF THE PREFERRED EMBODIMENTS

Figure 1:
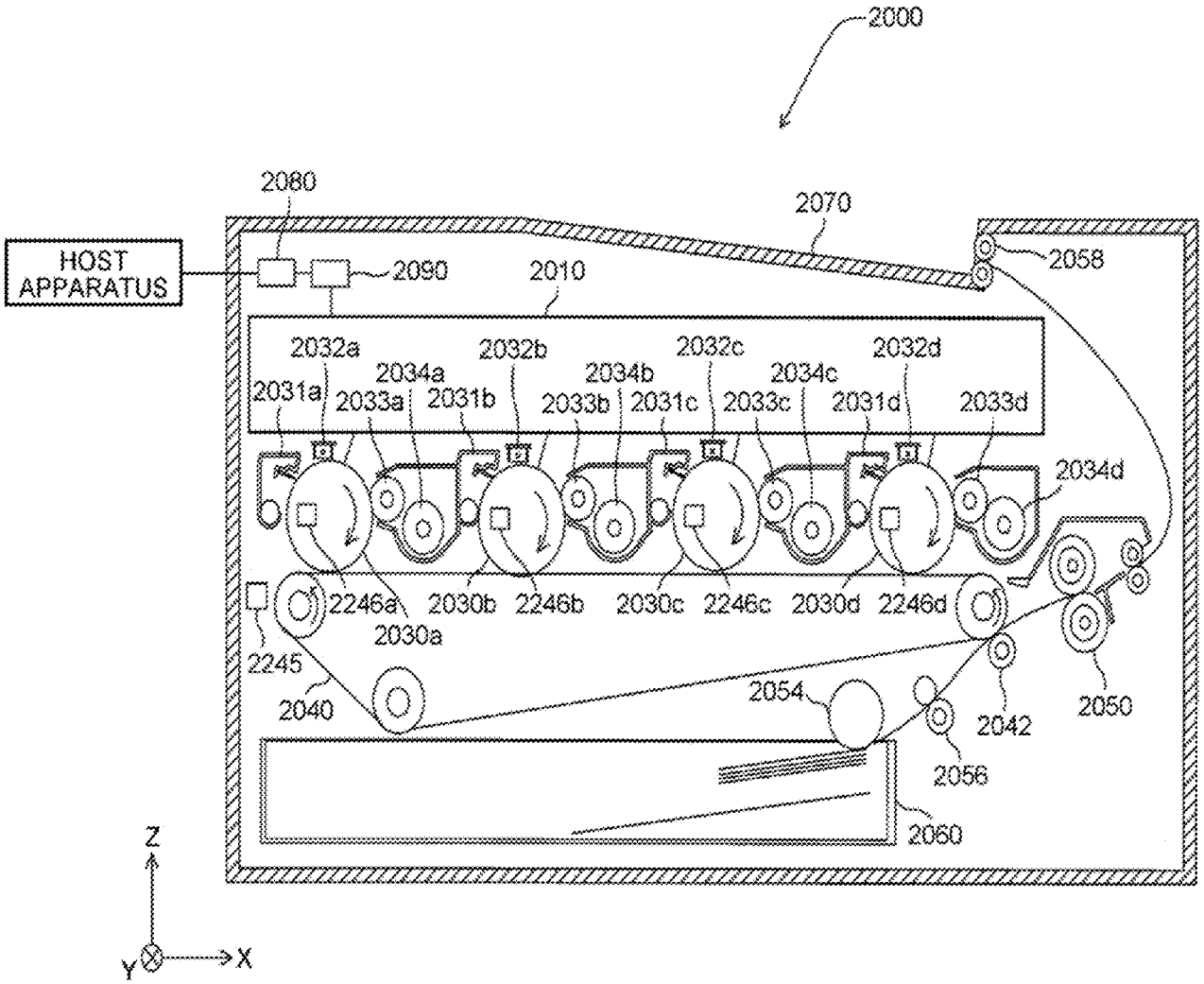
FIG. 1 is a diagram illustrating a schematic configuration of a color printer according to an embodiment of the present invention.

An embodiment of the present invention will be described below with reference to FIGS. 1 to 20. FIG. 1 illustrates a schematic configuration of a color printer 2000 serving as an image forming apparatus according to the embodiment.

The color printer 2000 is a multicolor printer of tandem system which forms a full color image by overlapping four colors (black, cyan, magenta, and yellow). The color printer 2000 includes an optical scanning device 2010 serving as an exposure device, four photoconductor drums (2030*a*, 2030*b*, 2030*c*, and 2030*d*), four cleaning units (2031*a*, 2031*b*, 2031*c*, and 2031*d*), four charging devices (2032*a*, 2032*b*, 2032*c*, and 2032*d*), four developing rollers (2033*a*, 2033*b*, 2033*c*, and 2033*d*), four toner cartridges (2034*a*, 2034*b*, 2034*c*, and 2034*d*), a transfer belt 2040, a transfer roller 2042, a fixing roller 2050, a sheet feeding roller 2054, a registration roller pair 2056, a paper ejection roller 2058, a sheet feeding tray 2060, a paper ejection tray 2070, a communication control device 2080, a density detector 2240, four home position sensors (2246*a*, 2246*b*, 2246*c*, and 2246*d*), four potential sensors (not illustrated), and a printer control device 2090 which controls the foregoing units in a centralized manner. In the following description, the four photoconductor drums (2030*a*, 2030*b*, 2030*c*, and 2030*d*) without distinction will be referred to collectively as photoconductor drums 2030. The four developing rollers (2033*a*, 2033*b*, 2033*c*, and 2033*d*) without distinction will be referred to collectively as developing rollers 2033.

The communication control device 2080 controls bidirectional communications with a host apparatus (for example, a personal computer) via a network and the like.

The printer control device 2090 includes a CPU, a ROM, a RAM, and an AD conversion circuit. The ROM stores a program described in code interpretable by the CPU, and various types of data to be used in executing the program. The RAM is a working memory. The AD conversion circuit converts analog data into digital data. The printer control device 2090 controls various units according to requests from the host apparatus, and transmits image data (image information) from the host apparatus to the optical scanning device 2010.

The photoconductor drum 2030*a*, the charging device 2032*a*, the developing roller 2033*a*, the toner cartridge 2034*a*, and the cleaning unit 2031*a* are used as a group, and constitute an image forming station that forms a black image (for the sake of convenience, may be hereinafter referred to as a "K station").

The photoconductor drum 2030*b*, the charging device 2032*b*, the developing roller 2033*b*, the toner cartridge 2034*b*, and the cleaning unit 2031*b* are used as a group, and constitute an image forming station that forms a cyan image (for the sake of convenience, may be hereinafter referred to as a "C station").

The photoconductor drum 2030*c*, the charging device 2032*c*, the developing roller 2033*c*, the toner cartridge 2034*c*, and the cleaning unit 2031*c* are used as a group, and constitute an image forming station that forms a magenta image (for the sake of convenience, may be hereinafter referred to as an "M station").

The photoconductor drum 2030*d*, the charging device 2032*d*, the developing roller 2033*d*, the toner cartridge 2034*d*, and the cleaning unit 2031*d* are used as a group, and constitute an image forming station that forms a yellow image (for the sake of convenience, may be hereinafter referred to as a "Y station").

The image forming stations may be hereinafter referred to simply as "stations."

The photoconductor drums each have a photoconductor layer formed on their surface. In other words, the surface of each photoconductor drum is a surface to be scanned. Each of the photoconductor drums is rotated by a not-illustrated rotation mechanism in the directions of the arrows in the plane of FIG. 1.

As employed herein, in an XYZ three-dimensional orthogonal coordinate system, a direction along the longitudinal direction of each of the photoconductor drums will be referred to as a Y-axis direction. A direction along the direction in which the four photoconductor drums are arranged will be referred to as an X-axis direction.

The charging devices uniformly charge the surfaces of the respective corresponding photoconductor drums.

The optical scanning device 2010 irradiates the charged surfaces of the photoconductor drums with modulated light beams of respective corresponding colors on the basis of multicolor image information (black image information, cyan image information, magenta image information, and yellow image information) from the host apparatus. As a result, electrical charges disappear from only the light-irradiated portions of the surfaces of the respective photoconductor drums, whereby latent images corresponding to the image information are formed on the surfaces of the respective photoconductor drums. The latent images formed here move toward the corresponding developing rollers as the photoconductor drums rotate. A configuration of the optical scanning device 2010 will be described later.

The area of each photoconductor drum where image information is written into may be referred to as an "effective scanning area," an "image formation area," or an "effective image area."

The toner cartridge 2034*a* contains black toner, which is supplied to the developing roller 2033*a*. The toner cartridge 2034*b* contains cyan toner, which is supplied to the developing roller 2033*b*. The toner cartridge 2034*c* contains magenta toner, which is supplied to the developing roller 2033*c*. The toner cartridge 2034*d* contains yellow toner, which is supplied to the developing roller 2033*d*.

As each developing roller rotates, the toner from the corresponding toner cartridge is thinly and uniformly applied to the surface of the developing roller. If the toner on the surface of each developing roller comes into contact with the surface of the corresponding photoconductor drum, the toner transfers and adheres to only the light-irradiated portions of the surface. In other words, the developing rollers visualize the latent images formed on the surfaces of the corresponding photoconductor drums by adhering the respective toners thereto. The toner-adhered images (toner images) move toward the transfer belt 2040 as the photoconductor drums rotate.

The yellow, magenta, cyan, and black toner images are successively transferred onto the transfer belt 2040 at predetermining timing, and overlapped to form a color image.

The sheet feeding tray 2060 contains recording sheets. The sheet feeding roller 2054 is arranged near the sheet feeding tray 2060. The sheet feeding roller 2054 takes out the recording sheets from the sheet feeding tray 2060 one by one, and conveys each recording sheet to the registration roller pair 2056. The registration roller pair 2056 sends out the recording sheet toward a gap between the transfer belt 2040 and the transfer roller 2042 at predetermined timing. The color image on the transfer belt 2040 is thereby transferred to the recording sheet. The transferred recording sheet is conveyed to the fixing roller 2050.

The fixing roller 2050 applies heat and pressure to the recording sheet, whereby the toner is fixed onto the recording sheet. The fixed recording sheet is conveyed to the paper ejection tray 2070 via the paper ejection roller 2058. In such a manner, fixed recording sheets are successively stacked on the paper ejection tray 2070.

The cleaning units remove toner (residual toner) remaining on the surfaces of the corresponding photoconductor drums. The surfaces of the photoconductor drums from which the residual toner is removed return to positions opposed to the corresponding charging devices again.

Figure 2:
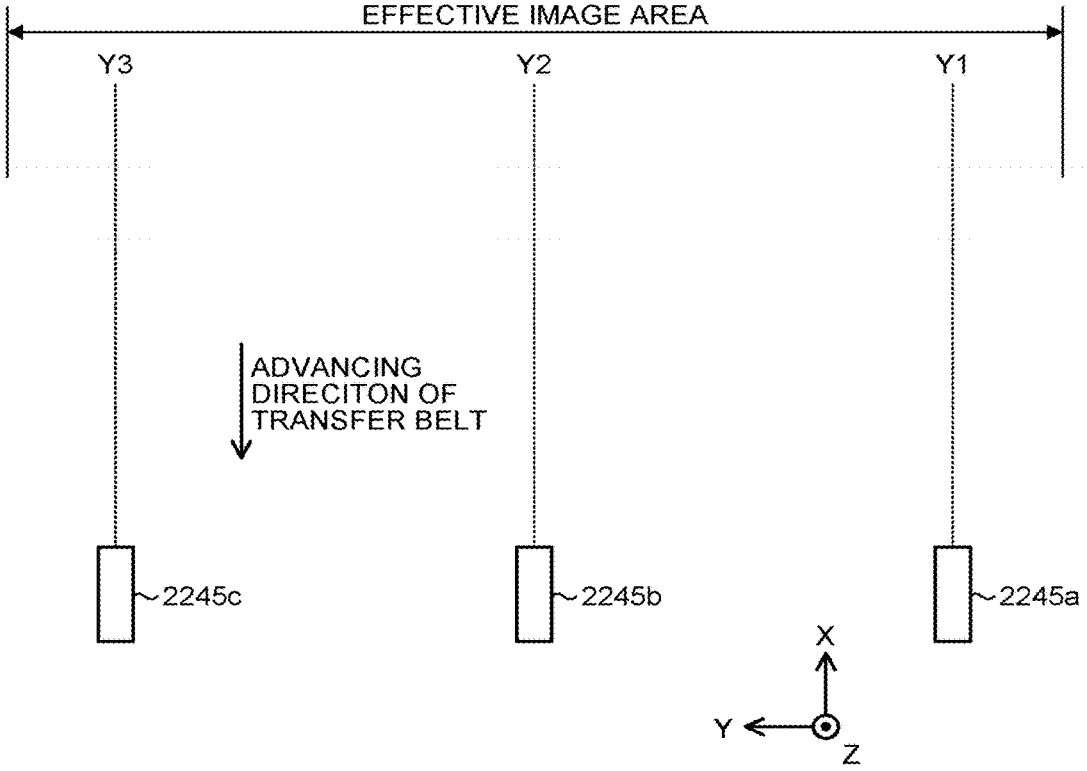
FIG. 2 is a diagram for describing a density detector.

The density detector 2240 is arranged in the negative X direction from the transfer belt 2040. For example, as illustrated in FIG. 2, the density detector 2240 includes three optical sensors (2245*a*, 2245*b*, and 2245*c*). In the following description, the three optical sensors (2245*a*, 2245*b*, and 2245*c*) without distinction will be referred to collectively as optical sensors 2245.

The optical sensor 2245*a* is arranged in a position opposed to near the end of the effective image area of the transfer belt 2040 in the negative Y direction. The optical sensor 2245*c* is arranged in a position opposed to near the end of the effective image area of the transfer belt 2040 in the positive Y direction. The optical sensor 2245*b* is arranged in a substantially center position between the optical sensors 2245*a* and 2245*c* in a main scanning direction. In the main scanning direction (Y-axis direction), the center position of the optical sensor 2245*a* will be denoted by Y1, the center position of the optical sensor 2245*b* will be denoted by Y2, and the center position of the optical sensor 2245*c* will be denoted by Y3.

Figure 3:
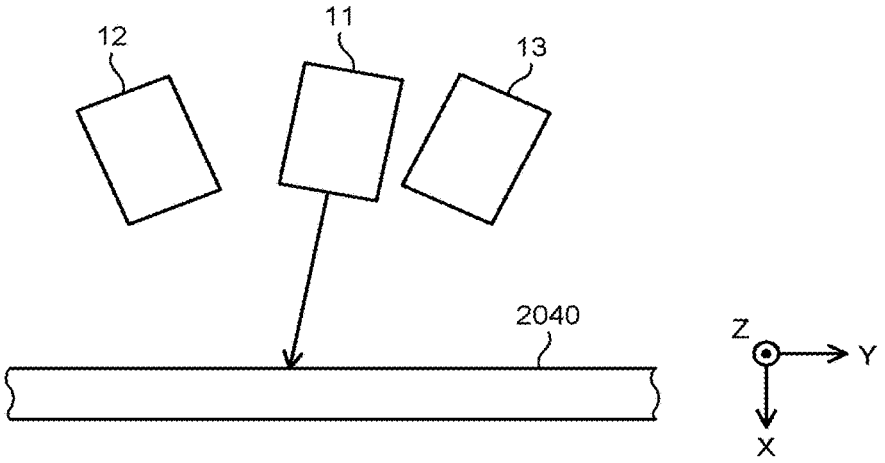
FIG. 3 is a diagram for describing an optical sensor.
Figure 4:
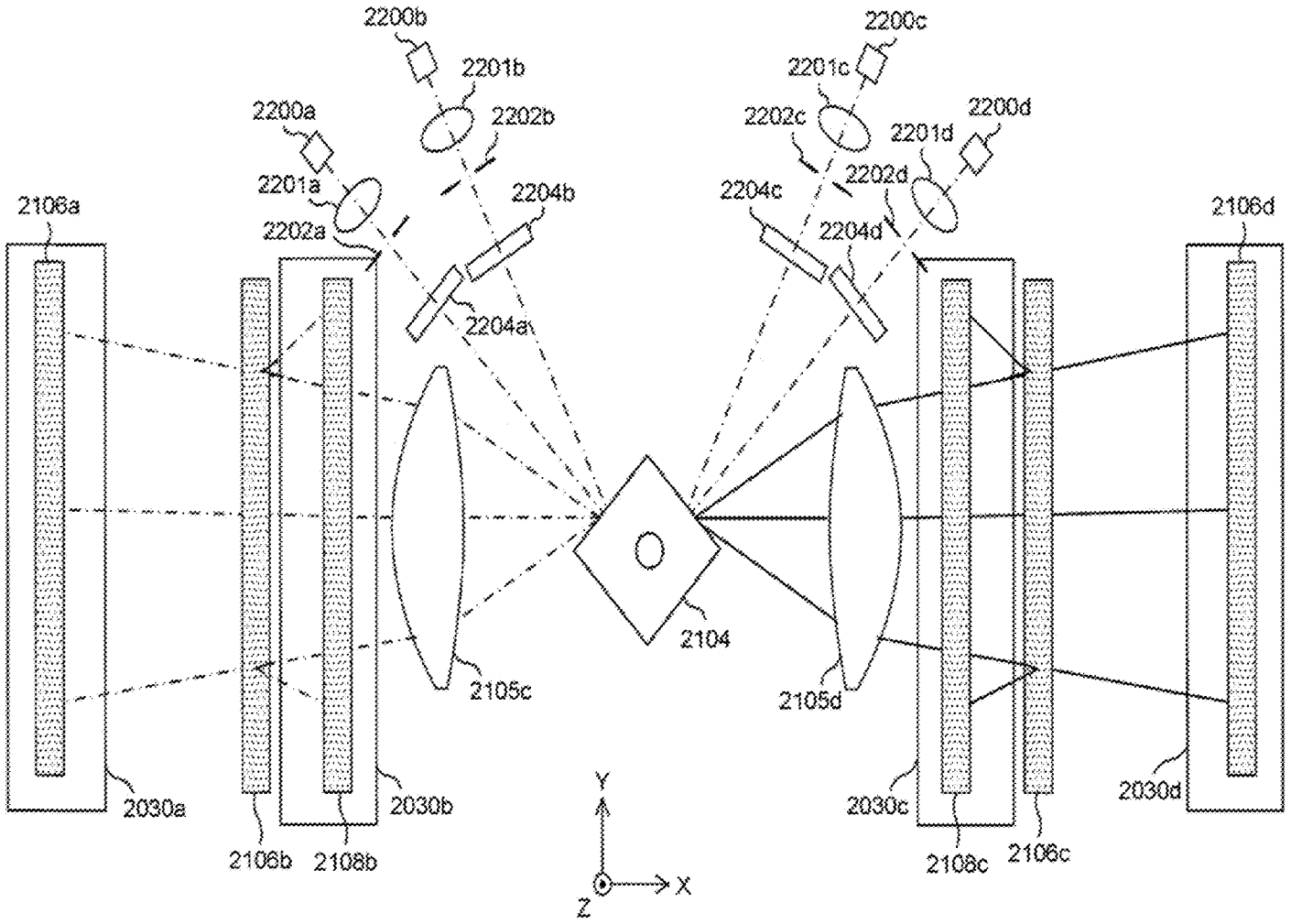
FIG. 4 is a diagram (part 1) for describing an optical scanning device.
Figure 5:
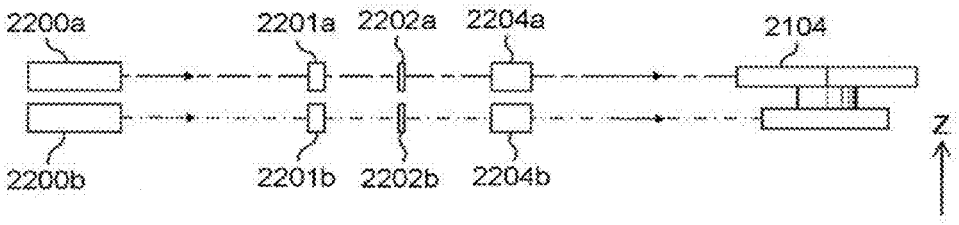
FIG. 5 is a diagram (part 2) for describing the optical scanning device.
Figure 6:
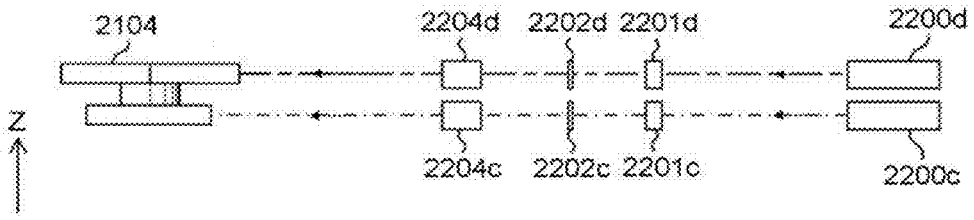
FIG. 6 is a diagram (part 3) for describing the optical scanning device.
Figure 7:
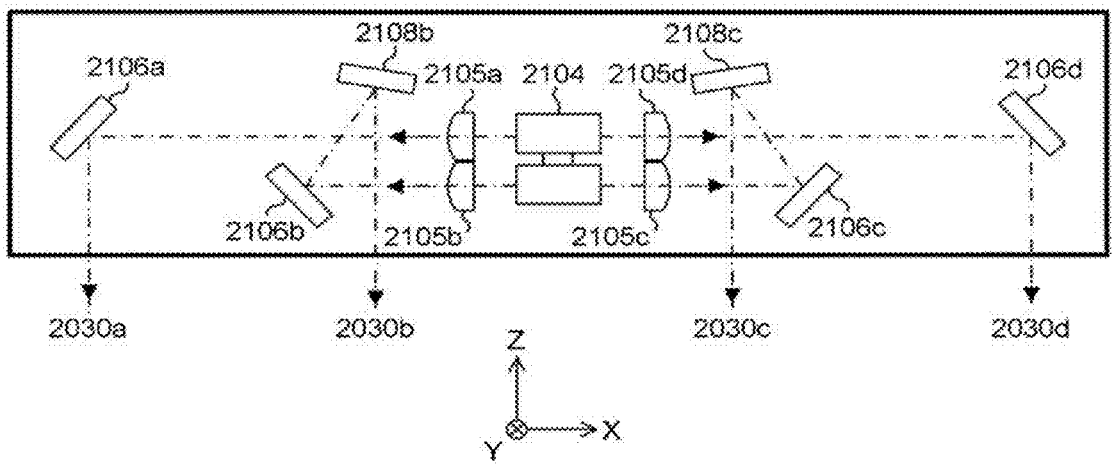
FIG. 7 is a diagram (part 4) for describing the optical scanning device.

For example, as illustrated in FIG. 3, each optical sensor includes an LED 11, a regular reflection light reception element 12, and a diffuse reflection light reception element 13. The LED 11 emits light (hereinafter, also referred to as "detection light") toward the transfer belt 2040. The regular reflection light reception element 12 receives regular reflection light from the transfer belt 2040 or a toner pad on the transfer belt 2040. The diffuse reflection light reception element 13 receives diffuse reflection light from the transfer belt 2040 or a toner pad on the transfer belt 2040. The light reception elements each output a signal (photoelectric conversion signal) according to the amount of light received.

The home position sensor 2246*a* detects a home position of rotation of the photoconductor drum 2030*a*.

The home position sensor 2246*b* detects a home position of rotation of the photoconductor drum 2030*b*.

The home position sensor 2246*c* detects a home position of rotation of the photoconductor drum 2030*c*.

The home position sensor 2246*d* detects a home position of rotation of the photoconductor drum 2030*d*.

The four potential sensors are arranged to be individually opposed to the respective four photoconductor drums 2030. The potential sensors detect surface potential information about the respective opposed photoconductor drums 2030.

Next, the configuration of the optical scanning device 2010 will be described.

Figure 8:
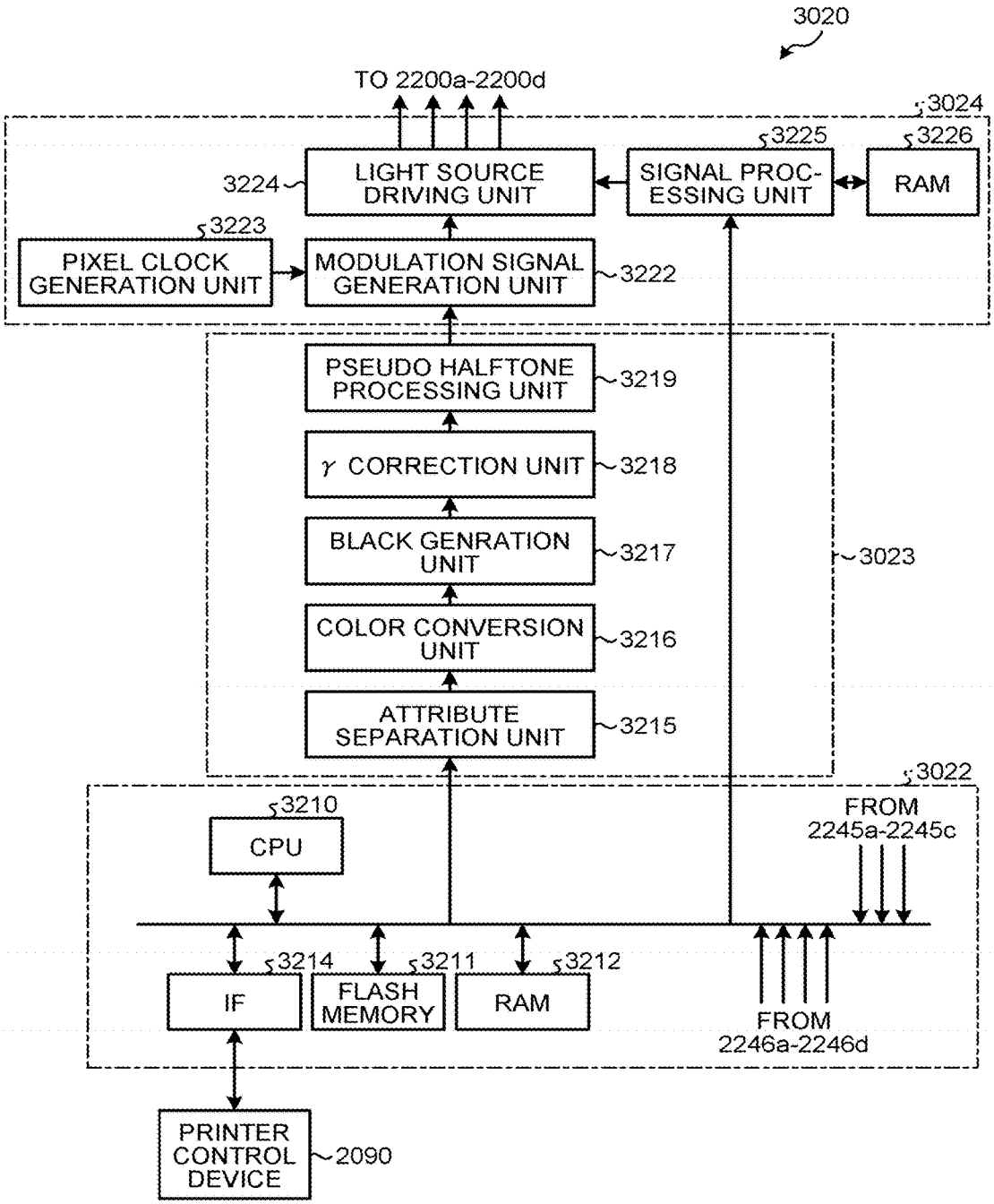
FIG. 8 is a diagram for describing a scanning control device.

For example, as illustrated in FIGS. 4 to 8, the optical scanning device 2010 includes four light sources (2200*a*, 2200*b*, 2200*c*, and 2200*d*), four coupling lenses (2201*a*, 2201*b*, 2201*c*, and 2201*d*), four aperture plates (2202*a*, 2202*b*, 2202*c*, and 2202*d*), four cylindrical lenses (2204*a*, 2204*b*, 2204*c*, and 2204*d*), a polygon mirror 2104, four scanning lenses (2105*a*, 2105*b*, 2105*c*, and 2105*d*), six folding mirrors (2106*a*, 2106*b*, 2106*c*, 2106*d*, 2108*b*, and 2108*c*), and a scanning control device 3020 (omitted in FIGS. 4 to 7; see FIG. 8). Such components are mounted on predetermined positions of an optical housing (not illustrated). In the following description, the four light sources (2200*a*, 2200*b*, 2200*c*, and 2200*d*) without distinction will be referred to collectively as light sources 2200.

The light sources each include a surface emitting laser array in which a plurality (for example, forty) of light emitting units are two-dimensionally arranged. For example, the plurality of light emitting units of the surface emitting laser array are arranged so that if all the light emitting units are orthogonally projected on a virtual line extending in a direction corresponding to the sub-scanning direction, light emitting unit intervals are equal. In other words, the plurality of light emitting units are arranged apart from each other at least in the direction corresponding to the sub-scanning direction. As employed herein, a "light emitting unit interval" refers to a center-to-center distance between two light emitting units.

The coupling lens 2201*a* is arranged on an optical path of a light beam emitted from the light source 2200*a*. The coupling lens 2201*a* converts the light beam into a substantially parallel light beam.

The coupling lens 2201*b* is arranged on an optical path of a light beam emitted from the light source 2200*b*. The coupling lens 2201*b* converts the light beam into a substantially parallel light beam.

The coupling lens 2201*c* is arranged on an optical path of a light beam emitted from the light source 2200*c*. The coupling lens 2201*c* converts the light beam into a substantially parallel light beam.

The coupling lens 2201*d* is arranged on an optical path of a light beam emitted from the light source 2200*d*. The coupling lens 2201*d* converts the light beam into a substantially parallel light beam.

The aperture plate 2202*a* has an opening, and shapes the light beam transmitted through the coupling lens 2201*a*.

The aperture plate 2202*b* has an opening, and shapes the light beam transmitted through the coupling lens 2201*b*.

The aperture plate 2202*c* has an opening, and shapes the light beam transmitted through the coupling lens 2201*c*.

The aperture plate 2202*d* has an opening, and shapes the light beam transmitted through the coupling lens 2201*d*.

The cylindrical lens 2204*a* focuses the light beam passed through the opening of the aperture plate 2202*a* on near a deflection reflecting surface of the polygon mirror 2104 in terms of a Z-axis direction.

The cylindrical lens 2204*b* focuses the light beam passed through the opening of the aperture plate 2202*b* on near a deflection reflecting surface of the polygon mirror 2104 in terms of the Z-axis direction.

The cylindrical lens 2204*c* focuses the light beam passed through the opening of the aperture plate 2202*c* on near a deflection reflecting surface of the polygon mirror 2104 in terms of the Z-axis direction.

The cylindrical lens 2204*d* focuses the light beam passed through the opening of the aperture plate 2202*d* on near a deflection reflecting surface of the polygon mirror 2104 in terms of the Z-axis direction.

An optical system including the coupling lens 2201*a*, the aperture plate 2202*a*, and the cylindrical lens 2204*a* is a pre-deflector optical system of the K station.

An optical system including the coupling lens 2201*b*, the aperture plate 2202*b*, and the cylindrical lens 2204*b* is a pre-deflector optical system of the C station.

An optical system including the coupling lens 2201*c*, the aperture plate 2202*c*, and the cylindrical lens 2204*c* is a pre-deflector optical system of the M station.

An optical system including the coupling lens 2201*d*, the aperture plate 2202*d*, and the cylindrical lens 2204*d* is a pre-deflector optical system of the Y station.

The polygon mirror 2104 includes four-surface mirrors of double stage structure, which rotate about an axis parallel to the Z-axis. Each mirror serves as deflection reflecting surfaces. The four-surface mirror in the first stage (lower stage) is arranged to deflect the light beam from the cylindrical lens 2204*b* and the light beam from the cylindrical lens 2204*c*. The four-surface mirror in the second stage (upper stage) is arranged to deflect the light beam from the cylindrical lens 2204*a* and the light beam from the cylindrical lens 2204*d*.

The light beams from the cylindrical lenses 2204*a* and 2204*b* are deflected in the negative X direction from the polygon mirror 2104. The light beams from the cylindrical lenses 2204*c* and 2204*d* are deflected in the positive X direction from the polygon mirror 2104.

Each scanning lens has optical power for condensing a light beam to near the corresponding photoconductor drum, and optical power such that a light spot moves over the surface of the corresponding photoconductor drum at constant speed in the main scanning direction as the polygon mirror 2104 rotates.

The scanning lenses 2105*a* and 2105*b* are arranged in the negative X direction from the polygon mirror 2104. The scanning lenses 2105*c* and 2105*d* are arranged in the positive X direction from the polygon mirror 2104.

The scanning lenses 2105*a* and 2105*b* are stacked in the Z-axis direction. The scanning lens 2105*b* is opposed to the four-surface mirror in the first stage. The scanning lens 2105*a* is opposed to the four-surface mirror in the second stage. The scanning lenses 2105*c* and 2105*d* are stacked in the Z-axis direction. The scanning lens 2105*c* is opposed to the four-surface mirror in the first stage. The scanning lens 2105*d* is opposed to the four-surface mirror in the second stage.

The light beam from the cylindrical lens 2204*a* is deflected by the polygon mirror 2104 to irradiate the photoconductor drum 2030*a* via the scanning lens 2105*a* and the folding mirror 2106*a*. This forms a light spot on the photoconductor drum 2030*a*. As the polygon mirror 2104 rotates, the light spot moves in the longitudinal direction of the photoconductor drum 2030*a*. In other words, the light spot scans over the photoconductor drum 2030*a*. The moving direction of the light spot here is the "main scanning direction" of the photoconductor drum 2030*a*. The rotation direction of the photoconductor drum 2030*a* is the "sub-scanning direction" of the photoconductor drum 2030*a*.

The light beam from the cylindrical lens 2204*b* is defected by the polygon mirror 2104 to irradiate the photoconductor drum 2030*b* via the scanning lens 2105*b* and the folding mirrors 2106*b* and 2108*b*. This forms a light spot on the photoconductor drum 2030*b*. As the polygon mirror 2104 rotates, the light spot moves in the longitudinal direction of the photoconductor drum 2030*b*. That is, the light spot scans over the photoconductor drum 2030*b*. The moving direction of the light spot here is the "main scanning direction" of the photoconductor drum 2030*b*. The rotation direction of the photoconductor drum 2030*b* is the "sub-scanning direction" of the photoconductor drum 2030*b*.

The light beam from the cylindrical lens 2204*c* is defected by the polygon mirror 2104 to irradiate the photoconductor drum 2030*c* via the scanning lens 2105*c* and the folding mirrors 2106*c* and 2108*c*. This forms a light spot on the photoconductor drum 2030*c*. As the polygon mirror 2104 rotates, the light spot moves in the longitudinal direction of the photoconductor drum 2030*c*. That is, the light spot scans over the photoconductor drum 2030*c*. The moving direction of the light spot here is the "main scanning direction" of the photoconductor drum 2030*c*. The rotation direction of the photoconductor drum 2030*c* is the "sub-scanning direction" of the photoconductor drum 2030*c*.

The light beam from the cylindrical lens 2204*d* is defected by the polygon mirror 2104 to irradiate the photoconductor drum 2030*d* via the scanning lens 2105*d* and the folding mirror 2106*d*. This forms a light spot on the photoconductor drum 2030*d*. As the polygon mirror 2104 rotates, the light spot moves in the longitudinal direction of the photoconductor drum 2030*d*. That is, the light spot scans over the photoconductor drum 2030*d*. The moving direction of the light spot here is the "main scanning direction" of the photoconductor drum 2030*d*. The rotation direction of the photoconductor drum 2030*d* is the "sub-scanning direction" of the photoconductor drum 2030*d*.

The folding mirrors are arranged so that the optical path lengths from the polygon mirror 2104 to the respective photoconductor drums coincide with each other, and the incident positions and incident angles of the light beams on the respective photoconductor drums are all equal.

Optical systems arranged on the optical paths between the polygon mirror 2104 and the respective photoconductor drums may be referred to as scanning optical systems. The scanning optical system of the K station includes the scanning lens 2105*a* and the folding mirror 2106*a*. The scanning optical system of the C station includes the scanning lens 2105*b* and two folding mirrors (2106*b* and 2108*b*). The scanning optical system of the M station includes the scanning lens 2105*c* and two folding mirrors (2106*c* and 2108*c*). The scanning optical system of the Y station includes the scanning lens 2105*d* and the folding mirror 2106*d*. In each of the scanning optical systems, the scanning lens may include a plurality of lenses.

FIG. 8 illustrates a configuration of the scanning control device 3020. As illustrated in FIG. 8, the scanning control device 3020 includes an interface unit 3022, an image processing unit 3023, and a driving control unit 3024.

Image data (input image data) of RGB format is transmitted to the interface unit 3022 from the host apparatus (for example, personal computer) via the communication control device 2080 and the printer control device 2090. The interface unit 3022 transfers the image data to the image processing unit 3023 in the subsequent stage.

The image processing unit 3023 functions as an image processing part. The image processing unit 3023 obtains the image data from the interface unit 3022, and converts the image data into color image data corresponding to a printing method. For example, the image processing unit 3023 converts the image data of RGB format into image data of tandem system (CMYK format). In addition to the conversion of data formats, the image processing unit 3023 applies various types of image processing to the image data. The image processing unit 3023 transmits the converted image data to the driving control unit 3024.

The driving control unit 3024 modulates the image data from the image processing unit 3023 by a clock signal indicating light emission timing of pixels, thereby generating independent modulation signals of respective colors. The driving control unit 3024 then drives the light sources 2200*a*, 2200*b*, 2200*c*, and 2200*d* to emit light according to the modulation signals corresponding to the respective colors.

An example of the driving control unit 3024 is a single-chip integrated device arranged near the light sources 2200*a*, 2200*b*, 2200*c*, and 2200*d*. Such a single-chip configuration facilitates attachment and detachment, and provides excellent maintainability and replaceability. As compared to the driving control unit 3024, the image processing unit 3023 and the interface unit 3022 are arranged farther than the light sources 2200*a*, 2200*b*, 2200*c*, and 2200*d*. The image processing unit 3023 and the driving control unit 3024 are connected via a cable or cables (not illustrated).

The optical scanning device 2010 configured as described above can make the respective light sources emit light according to the image data, thereby forming latent images on the surfaces of the corresponding photoconductor drums.

The units of the scanning control device 3020 will be described in detail below.

For example, the interface unit 3022 includes a flash memory 3211, a RAM 3212, an IF 3214, and a CPU 3210. The flash memory 3211, the RAM 3212, the IF 3214, and the CPU 3210 are connected to each other via a bus.

The flash memory 3211 stores a program to be executed by the CPU 3210 and various types of data needed for the CPU 3210 to execute the program. The RAM 3212 is a working storage area to be used when the CPU 3210 executes the program. The IF 3214 performs bidirectional communications with the printer control device 2090.

The CPU 3210 operates according to the program stored in the flash memory 3211, and controls the entire optical scanning device 2010.

The interface unit 3022 configured thus passes the input image data (resolution N, 8-bit, RGB format) from the printer control device 2090 to the image processing unit 3023.

The image processing unit 3023 includes an attribute separation unit 3215, a color conversion unit 3216, a black generation unit 3217, a γ correction unit 3218, and a pseudo halftone processing unit 3219.

The attribute separation unit 3215 receives the input image data (resolution N, 8-bit, RGB format) from the interface unit 3022. Each pixel of the input image data is accompanied by attribute information (attribute data). The attribute information indicates the type of a source object of that area (pixel). For example, if the pixel is a part of a character, the attribute information indicates an attribute representing "character." For example, if the pixel is a part of a line, the attribute information indicates an attribute representing "line." If the pixel is a part of a graphic figure, the attribute information indicates an attribute representing "figure." If the pixel is a part of a picture, the attribute information indicates an attribute representing "picture."

The attribute separation unit 3215 separates the input image data into attribute information and image data. The attribute separation unit 3215 transmits the image data (resolution N, 8-bit, RGB format) to the color conversion unit 3216.

The color conversion unit 3216 converts the image data of RGB format from the attribute separation unit 3215 into image data of CMY format, and transmits the image data of CMY format to the black generation unit 3217.

The black generation unit 3217 generates a black component from the image data of CMY format, thereby generating image data of CMYK format. The black generation unit 3217 transmits the image data of CMYK format to the γ correction unit 3218.

The γ correction unit 3218 performs linear conversion on the level of each color of the image data of CMYK format from the black generation unit 3217 by using a table or the like. The γ correction unit 3218 transmits the resulting image data of CMYK format to the pseudo halftone processing unit 3219.

The pseudo halftone processing unit 3219 reduces the number of gradations of the image data of CMYK format from the γ correction unit 3218, and outputs 1-bit image data. More specifically, the pseudo halftone processing unit 3219 reduces the number of gradations of 8-bit image data to one bit by, for example, performing pseudo halftone processing such as dither processing and error diffusion processing. As a result, periodic screens (such as a halftone dot screen and a line screen), i.e., pattern-forming screens of the image data are formed. The pseudo halftone processing unit 3219 then transmits the resolution-N 1-bit image data of CMYK format to the driving control unit 3024.

Part or all of the image processing unit 3023 may be implemented by hardware. The image processing unit 3023 may be implemented by the CPU 3210 executing a software program.

The driving control unit 3024 includes a pixel clock generation unit 3223, a modulation signal generation unit 3222, a light source driving unit 3224, a signal processing unit 3225, and a RAM (random access memory) 3226.

The pixel clock generation unit 3223 generates a pixel clock signal which indicates the light emission timing of pixels.

The modulation signal generation unit 3222 modulates the image data from the image processing unit 3023 by the pixel clock signal to generate color-by-color independent modulation signals (driving signals), and transmits the modulation signals to the light source driving unit 3224.

According to the color-by-color independent modulation signals from the modulation signal generation unit 3222, the light source driving unit 3224 drives the corresponding light sources 2200. The light source driving unit 3224 can thereby make the respective light sources 2200 emit light with the amounts of light according to the corresponding modulation signals.

The signal processing unit 3225 generates light amount correction data (correction data for the modulation signals)

of the light sources on the basis of output signals of the respective optical sensors. The signal processing unit 3225 stores the light amount correction data into the RAM 3226.

The optical scanning device 2010 configured thus can make the respective light sources 2200 emit light according to the image data and form latent images on the surfaces of the photoconductor drums corresponding to the respective light sources.

Now, if a photoconductor drum is eccentric or has a low sectional roundness, a gap between the photoconductor drum and the developing roller varies during image formation. Such variation in the gap results in variation of development, causing unnecessary periodic density variation in the sub-scanning direction in an image (also referred to as an "output image") output from the image forming apparatus. Other factors of such periodic density variation include eccentricity or a low sectional roundness of the developing rollers and the charging rollers, and potential unevenness of the photoconductors.

A demand for image quality has been increasing in recent years. In particular, high uniformity within a page has been demanded. To correct such periodic density variation, a method for periodically modulating the amounts of light emission of the light sources to correct density variation is effective.

In the present embodiment, light amount correction data acquisition processing is then performed to obtain light amount correction data for correcting the amounts of light emission (driving signals) of the light sources.

The light amount correction data acquisition processing of the present embodiment will be described below with reference to FIG. 9. The flow chart of FIG. 9 corresponds to a processing algorithm to be executed by the signal processing unit 3225. For example, the light amount correction data acquisition processing is performed station by station on a regular basis (for example, at every 8 hours to 24 hours). Here, the K station will be described in a representative manner.

In the first step S1, a density variation measurement pattern is formed on the transfer belt 2040.

Figure 10:
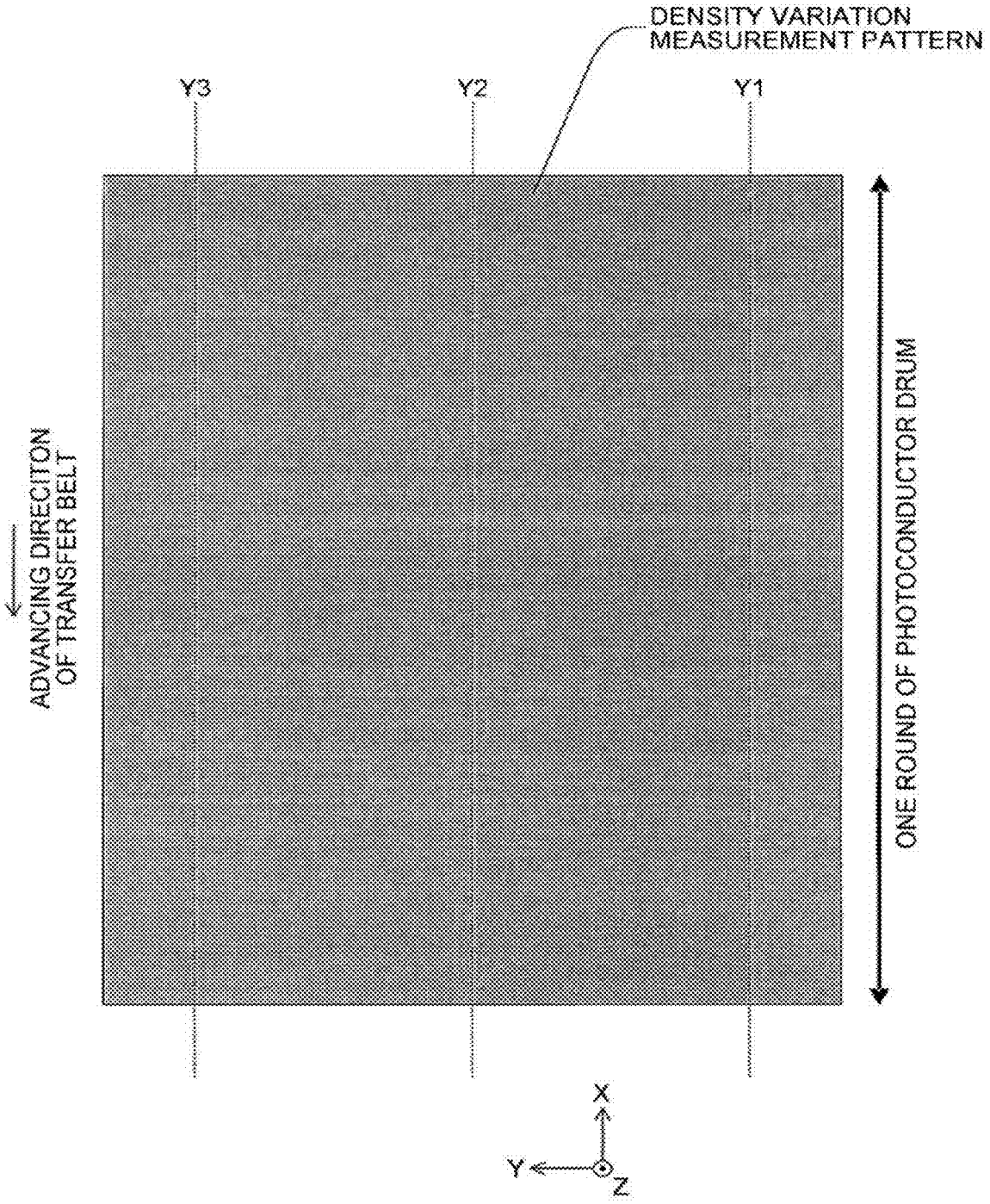
FIG. 10 is a diagram illustrating a density variation measurement pattern.
Figure 11:
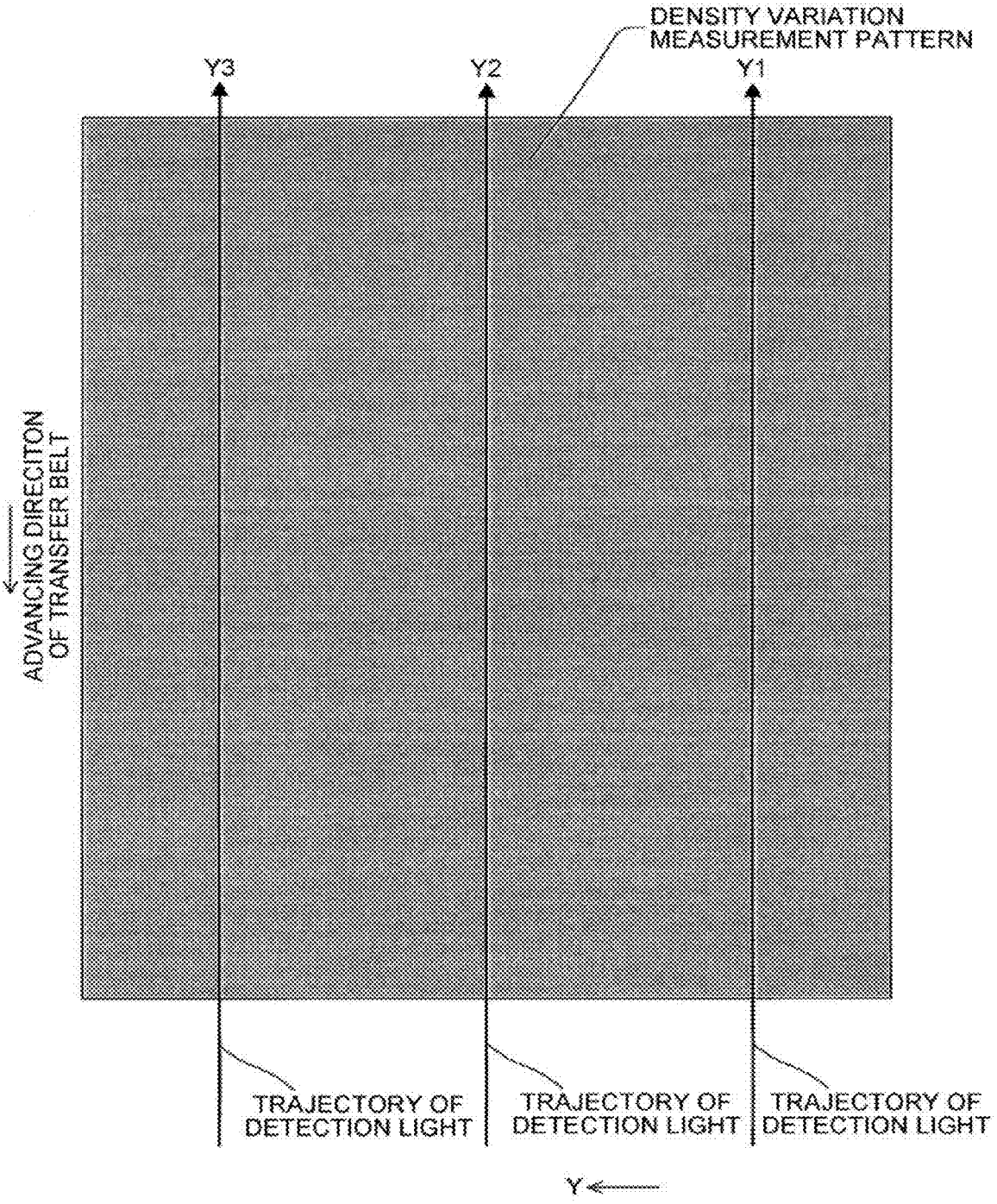
FIG. 11 is a diagram for describing trajectories of detection light with respect to the density variation measurement pattern.
Figure 12:
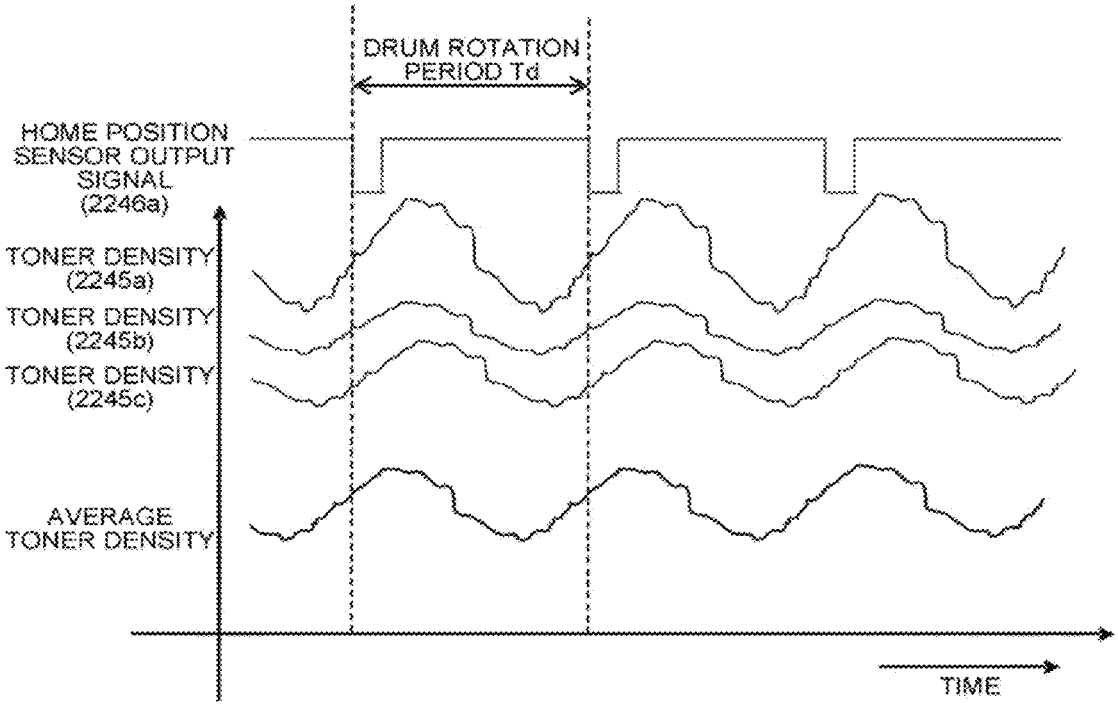
FIG. 12 is a diagram illustrating output signals of optical sensors and an average of the output signals of three optical sensors.

Specifically, all the light emitting units of the optical scanning device 2010 are turned on to emit the same amount of light, and the surface of the photoconductor drum 2030*a* is scanned to form a density variation measurement pattern on the transfer belt 2040. As illustrated in FIG. 10, the density variation measurement pattern includes a solid pattern for one round of the photoconductor drum. The LEDs 11 of the optical sensors are then turned on. Detection light from each LED 11 illuminates the density variation measurement pattern along the sub-scanning direction as the transfer belt 2040 rotates (circulates), i.e., as time elapses (see FIG. 11).

In the next step S2, density variation of the density variation measurement pattern in the sub-scanning direction is obtained.

Specifically, the signal processing unit 3225 obtains the output signals of the regular reflection light reception elements 12 and the diffuse reflection light reception elements 13 at predetermined time intervals. From the output signals of the sensors, the signal processing unit 3225 calculates toner densities to obtain an average toner density (average of the three toner densities) (see FIG. 12).

In the next step S3, the density variation of the density variation measurement pattern in the sub-scanning direction is approximated by using a periodic function.

Figure 13:
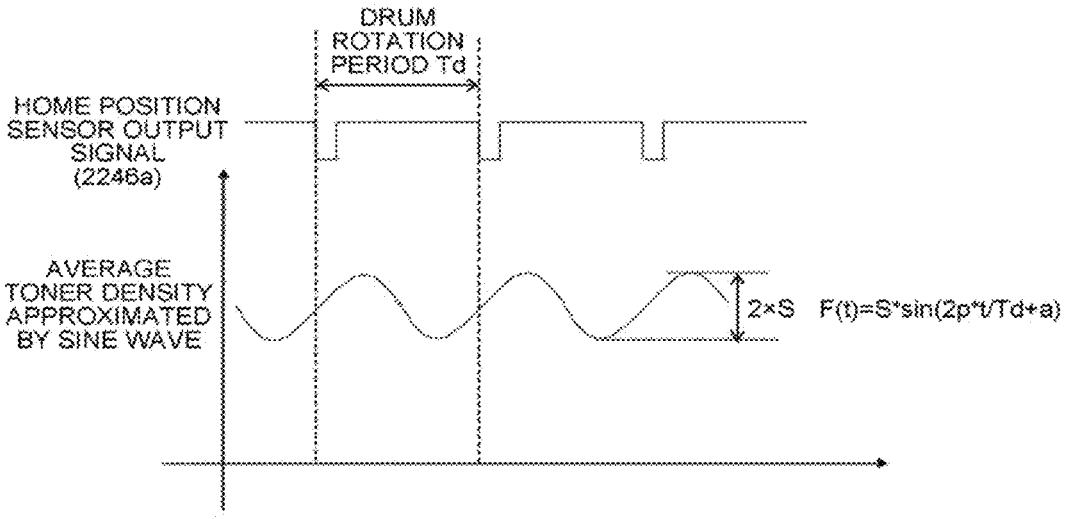
FIG. 13 is a diagram illustrating a signal that approximates the average of the output signals of the three optical sensors in a sinusoidal manner.

Specifically, on the basis of the output signal of the home position sensor 2246*a* (hereinafter, also referred to as an HP signal), a periodic function, for example, a sine wave having the same period as the rotation period (drum rotation period Td) of the photoconductor drum 2030*a* is extracted as a periodic pattern from the average toner density (see FIG. 13).

In the next step S4, light amount correction data (for the rotation period (one period) of the photoconductor drum 2030*a*) is generated.

Specifically, the signal processing unit 3225 converts the periodic pattern for one period, obtained in step S3, into light amount correction data for the rotation period of the photoconductor drum 2030*a* (the same periodic pattern as the obtained periodic pattern but with a phase shift of 180°). That is, the light amount correction data is generated to suppress density variation in the sub-scanning direction of the photoconductor drum 2030*a*. The light amount correction data obtained thus has a correction period substantially coincident with the rotation period of the photoconductor drum 2030*a*.

In the next step S5, the light amount correction data is stored into the RAM 3226.

Figure 14:
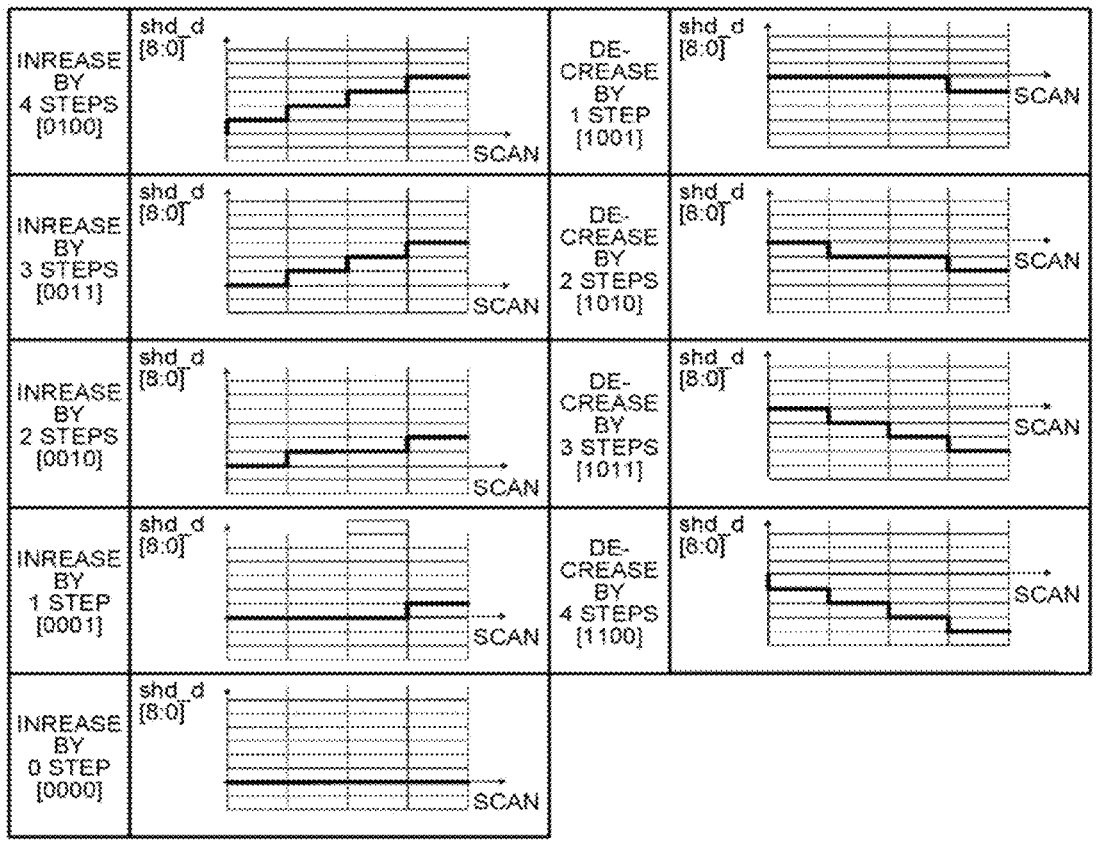
FIG. 14 is a diagram for describing a method for storing light amount correction data in a RAM.

Specifically, as illustrated in FIG. 14, the signal processing unit 3225 converts a light amount correction value into a quantized difference value which indicates by how many steps to modulate the light amount from the previous scan. The signal processing unit 3225 stores the difference value into the RAM 3226. This reduces the amount of data stored in the RAM 3226. The number of steps and the amount of the step of the light amount modulation are determined by, for example, a minimum resolution and the like of the light amount modulation. To suppress image defects, it is basically desirable that one scan includes modulation of 0, ±1, or ±2 steps of the minimum resolution. Such a light amount correction value is not stored for each scan, but generated and stored in units of a plurality of scans (for example, for every four scans; see FIG. 14). This can further reduce the amount of data stored in the RAM 3226. The light amount correction value in units of a plurality of scans is expanded over and applied as correction values for respective scans as illustrated in FIG. 14.

Figure 9:
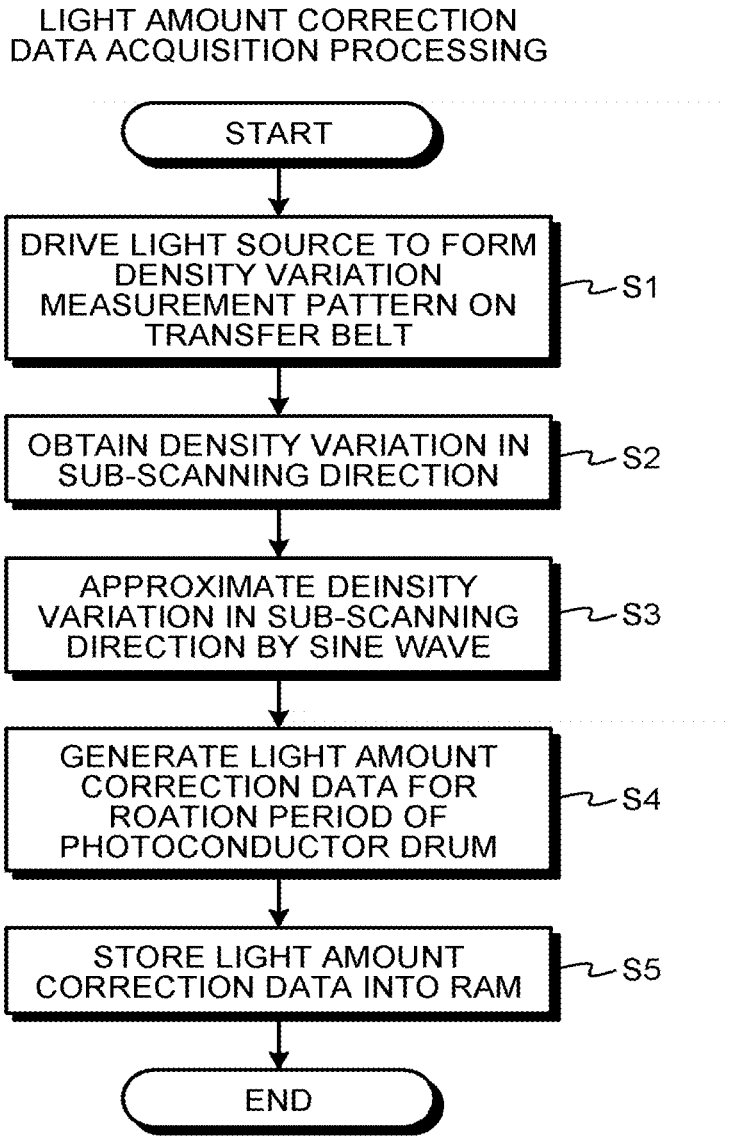
FIG. 9 is a flow chart for describing light amount correction data acquisition processing.

After the light amount correction data acquisition processing illustrated in the flow chart of FIG. 9 is performed as described above, image data is input from the host apparatus to the interface unit 3022 via the communication control device 2080 and the printer control device 2090. The image processing unit 3023 applies predetermined processing to the image data, and then transmits the resulting image data to the driving control unit 3024.

The modulation signal generation unit 3222 generates the modulation signals (driving signals) of the respective colors according to the image data on the basis of the pixel clock signal from the pixel clock generation unit 3223. The modulation signal generation unit 3222 transmits the modulation signals to the light source driving unit 3224.

Here, the signal processing unit 3225 reads the light amount correction data of the respective stations from the RAM 3226, and transmits the light amount correction data to the light source driving unit 3224.

The light source driving unit 3224 superimposes the light amount correction data for the modulation signals of the respective colors to correct the modulation signals, and outputs the corrected modulation signals to the respective light sources.

The surfaces of the rotating photoconductor drums are scanned in the main scanning direction by the light emitted from the respective corresponding light sources driven by the corrected modulation signals.

As a result, toner images whose density variation in the sub-scanning direction are suppressed are formed on the surfaces of the photoconductor drums, and eventually a high quality image is formed on a recording sheet.

Now, the rotation period (linear speed) of the photoconductor drums can be changed, for example, in the case of changing productivity or making adjustments to an image formation engine.

As described above, the light amount correction values are stored in the RAM 3226 in units of a plurality of scans. If the rotation period of the photoconductor drums is changed, the period of the light amount correction data and the period of density variation (the rotation period of the photoconductor drums) may deviate from each other. This results in a failure of accurate correction of the density variation. A description will be given by using a specific example.

Figure 15:
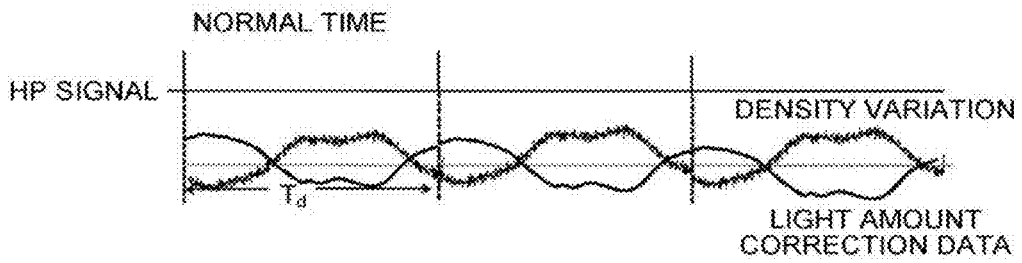
FIG. 15 is a diagram illustrating density variation in a sub-scanning direction and light amount correction data at normal time.

FIG. 15 illustrates density variation in the sub-scanning direction of a photoconductor drum and light amount correction data at normal time. In such a case, the period of the light amount correction data and the period Td (drum rotation period Td) of the density variation are substantially the same.

Figure 16:
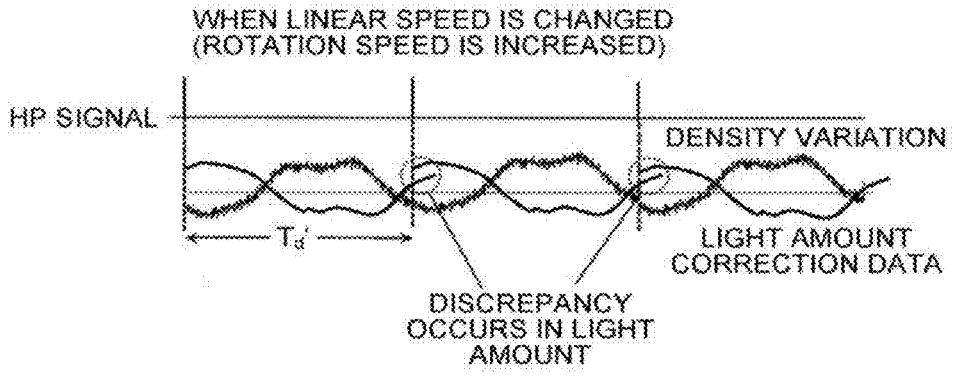
FIG. 16 is a diagram illustrating density variation in the sub-scanning direction when a linear speed of a photoconductor drum is increased, and the light amount correction data at normal time.

FIG. 16 illustrates a case where the linear speed of the photoconductor drum is changed from the normal time to increase the rotation speed of the photoconductor drum. In such a case, density variation has a period Td' (drum rotation period Td') shorter than the period Td of density variation at normal time. The period of the light amount correction data thus becomes longer than the period Td' of the density variation, and a discrepancy occurs in the light amount correction data at the time of restart by the next HP signal (home position sensor output signal).

Figure 17:
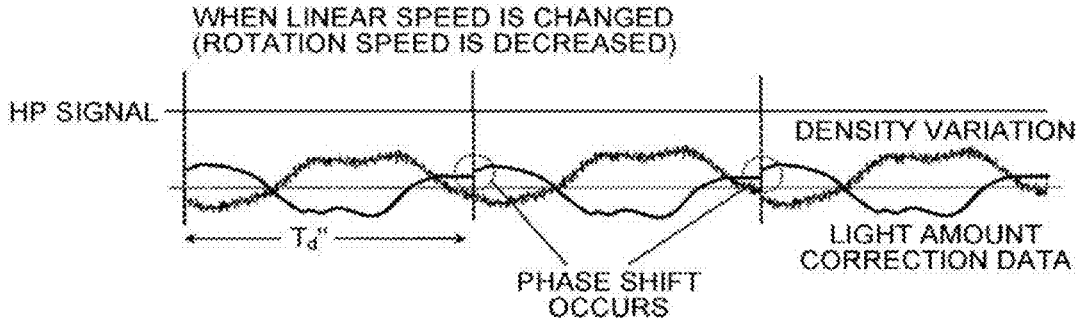
FIG. 17 is a diagram illustrating density variation in the sub-scanning direction when the linear speed of the photoconductor drum is decreased, and the light amount correction data at normal time.

FIG. 17 illustrates a case where the linear speed of the photoconductor drum is changed from the normal time to decrease the rotation speed of the photoconductor drum. In such a case, density variation has a period Td" (drum rotation period Td") longer than the period Td of density variation at normal time. The period of the light amount correction data thus becomes shorter than the period Td" of the density variation. Favorable correction becomes difficult because of a phase shift with respect to the density variation.

As one method for adjusting the period of the light amount correction data to that of density variation (the rotation period of the photoconductor drum), the light amount correction data may be updated (light amount correction data may be obtained again) each time the linear speed of the photoconductor drum is changed.

However, the update of the light amount correction data is typically performed by software calculation. Frequent data update results in a drop in productivity due to time needed for the software calculation and transfer time.

Then, in the present embodiment, correction period adjustment processing 1 for adjusting the correction period of the light amount correction data is performed to suppress a drop in productivity and stably suppress density variation of an image in the sub-scanning direction.

The correction period adjustment processing 1 according to the present embodiment will be described below with reference to FIG. 18. The flow chart of FIG. 18 corresponds to a processing algorithm to be executed by the signal processing unit 3225.

The correction period adjustment processing 1 is performed after the light amount correction data acquisition processing is performed. The correction period adjustment processing 1 is performed station by station when the rotation period of the photoconductor drum is changed. The correction period of light amount correction data coincides with the rotation period of the photoconductor drum at the time when the light amount correction data is obtained. The correction period adjustment processing 1 is performed on each station similarly. Here, the K station will be described in a representative manner.

The signal processing unit 3225 monitors the rotation period of the photoconductor drum 2030*a* on the basis of the output signal of the corresponding home position sensor 2246*a*. If the rotation period is determined to be "changed," the signal processing unit 3225 starts the correction period adjustment processing 1. To be more specific, if the amount of change of the rotation period is greater than or equal to a predetermined value, the signal processing unit 3225 determines that the rotation period is "changed." If the amount of change is smaller than the predetermined value, the signal processing unit 3225 determines that the rotation period is "not changed." Such a determination is intended to prevent a misjudgment due to a detection error etc. Examples of the situation where the rotation period of the photoconductor drum 2030*a* changes include a case where the linear speed of the photoconductor drum 2030*a* is changed to adjust productivity, a case where the linear speed of the photoconductor drum 2030*a* decreases because of deterioration of the driving system of the photoconductor drum 2030*a* over time, and a case where a minor trouble occurs in the driving system of the photoconductor drum 2030*a*.

In the first step S11, the changed rotation period is obtained. Specifically, the signal processing unit 3225 obtains the changed rotation period of the photoconductor drum 2030*a* on the basis of the output signal of the home position sensor 2246*a*.

In the next step S12, the correction period of the light amount correction data is made substantially coincident with the changed rotation period.

Specifically, the signal processing unit 3225 compares the number of correction values (light amount correction values) (the number of scans) of the light amount correction data for the rotation period of the photoconductor drum 2030*a*, stored in the RAM 3226, with the number of correction values (number of scans) needed due to the change of the rotation period of the photoconductor drum 2030*a*.

Figure 19:
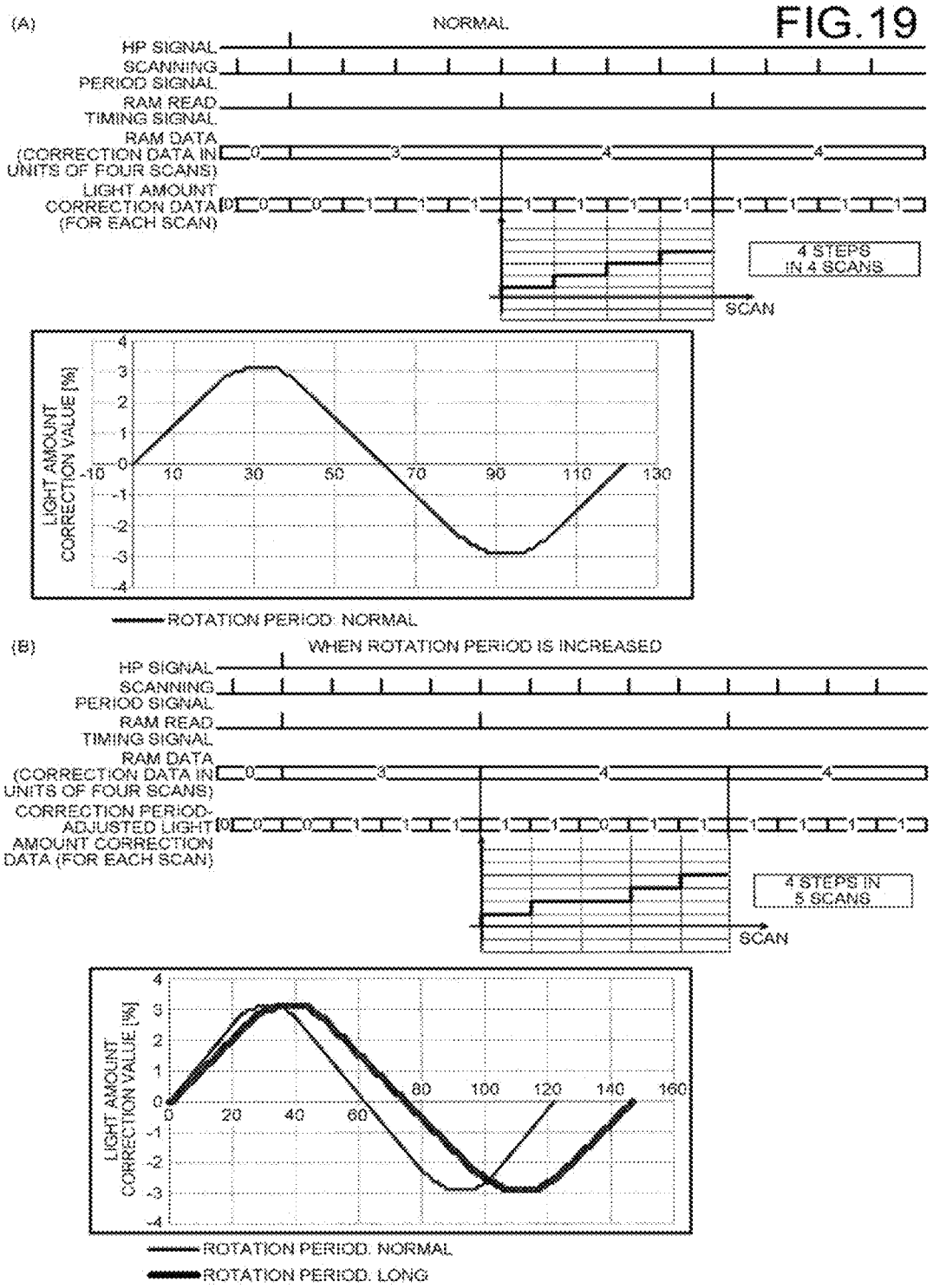
FIG. 19 is a diagram illustrating, at (A), normal light amount correction data, and, at (B), a method for adjusting a correction period of the light amount correction data when the linear speed of the photoconductor drum is decreased.

As illustrated at (A) in FIG. 19, correction values are normally stored in units of four scans and expanded over four scans. If the number of scans needed for correction for the actual rotation period of the photoconductor drum is greater than the number of correction values (number of scans) stored in the RAM 3226 (if the linear speed of the photoconductor drum decreases and the rotation period of the photoconductor drum (the period of density variation) becomes longer than the period of the light amount correction data), the signal processing unit 3225 expands the correction values (for example, 1) over five scans in a regular manner (for example, periodically or at substantially equal intervals) as many times as the increase in the number of scans (see (B) in FIG. 19). Here, the correction value for the one additional scan is set to be 0 so that the total sum of the correction values in the five scans remains the same as that of the original correction values (for example, 4). The correction values to be normally stored are not limited to be in units of four scans, and may be in units of a plurality of scans. The number of additional scans with a correction value of 0 is not limited to one, and may be more than one. Scans with a correction value of 0 do not need to be added in a regular manner (for example, periodically or at substantially equal intervals), and may be added at random (irregularly).

In other words, processing equivalent to the regular insertion of data on the correction value of 0 is performed to increase (perform period modulation on) the correction period for the rotation period of the light amount correction data so that the correction period substantially coincides with the changed rotation period (see (B) in FIG. 19). The upper half (timing chart) at (B) in FIG. 19 illustrates only an excerpt of the correction period-adjusted light amount correction data corresponding to on-sheet lengths of 0.0 mm to 10.0 mm. The upper half (timing chart) at (A) in FIG. 19 illustrates only an excerpt of the light amount correction data including a part corresponding to on-paper lengths of 0.0 mm to 10.0 mm.

Figure 20:
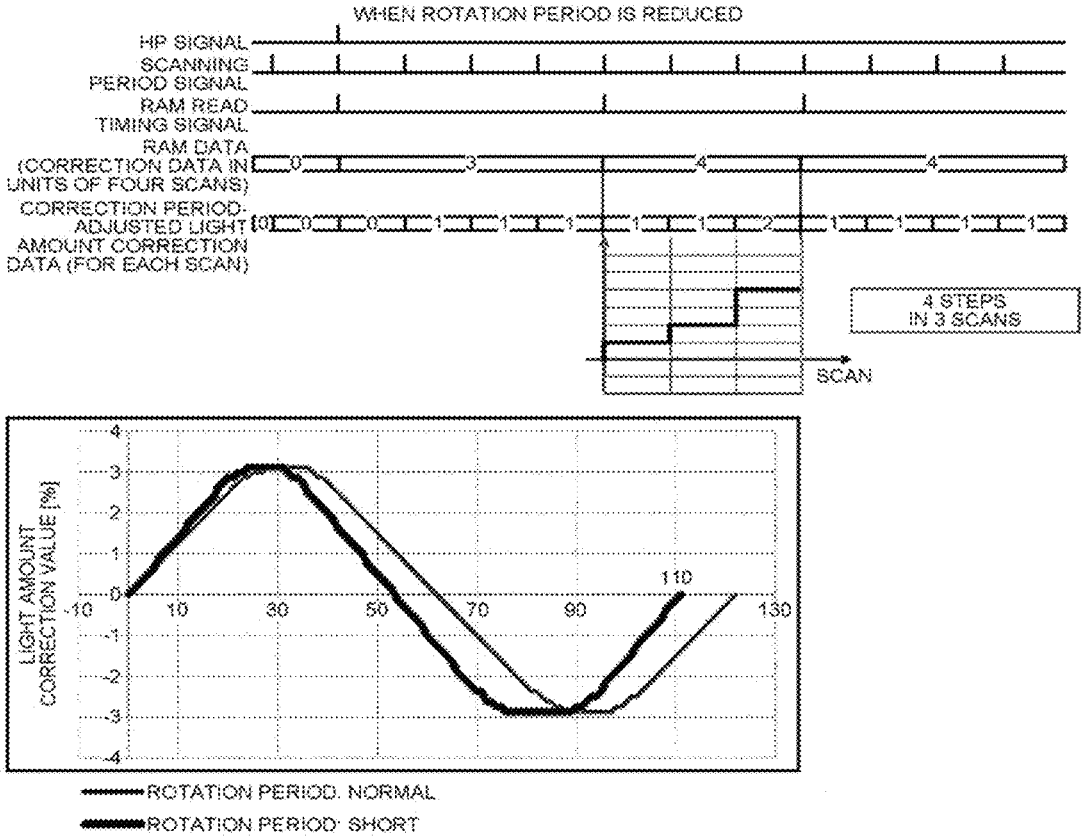
FIG. 20 is a diagram for describing a method for adjusting the correction period of the light amount correction data when the linear speed of the photoconductor drum is increased.

Now, if the number of scans needed for correction for the actual rotation period of the photoconductor drum is smaller than the number of correction values (number of scans) stored in the RAM 3226 (if the linear speed of the photoconductor drum increases and the rotation period of the photoconductor drum (the period of density variation) becomes shorter than the period of the light amount correction data), the signal processing unit 3225 expands the correction values (for example, 1) which are normally stored as values in units of four scans and expanded over four scans as illustrated at (A) in FIG. 19 over three scans as many times as the decrease in the number of scans. The signal processing unit 3225 thereby reduces (performs period modulation on) the correction period of the light amount correction data so that the correction period substantially coincides with the changed rotation period (see FIG. 20). For example, the correction value in one of the three scans is set to 2 so that the total sum of the correction values in the three scans remains the same as that of the original correction values (for example, 4). The correction values to be normally stored are not limited to be in units of four scans, and may be in units of a plurality of scans. The number of scans to be deleted is not limited to one, and may be more than one so long as the total sum of the correction values is not changed. The number of scans does not need to be reduced in a regular manner (for example, periodically or at substantially equal intervals), and may be reduced at random (irregularly). The upper half (timing chart) of FIG. 20 illustrates only an excerpt of the correction period-adjusted light amount correction data corresponding to on-paper lengths of 0.0 mm to 10.0 mm.

Figure 18:
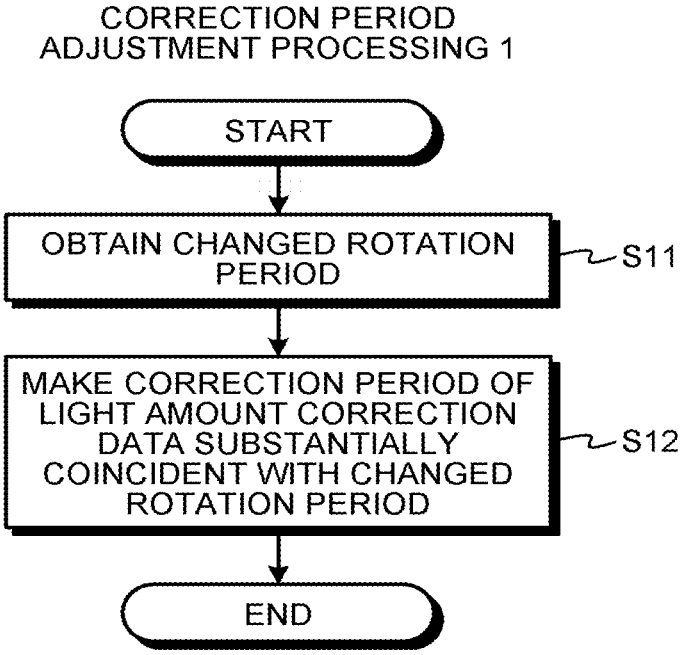
FIG. 18 is a flow chart for describing correction period adjustment processing 1.

After the correction period adjustment processing 1 illustrated in the flow chart of FIG. 18 is performed as described above, image data is input from the host apparatus to the interface unit 3022 via the communication control device 2080 and the printer control device 2090. The image processing unit 3023 applies predetermined processing to the image data, and transmits the resulting image data to the driving control unit 3024.

The modulation signal generation unit 3222 generates the modulation signals (driving signals) of the respective colors according to the image data on the basis of the pixel clock signal from the pixel clock signal generation unit 3223. The modulation signal generation unit 3222 transmits the modulation signals to the light source driving unit 3224.

The light source driving unit 3224 superimposes the correction period-adjusted light amount correction data for the modulation signals of the respective colors to correct the modulation signals, and outputs the corrected modulation signals to the respective light sources.

Here, the surfaces of the rotating photoconductor drums are scanned by the light emitted from the respective corresponding light sources driven by the corrected modulation signals.

As a result, toner images whose density variation in the sub-scanning direction are suppressed are formed on the surfaces of the photoconductor drums, and eventually a high quality image is formed on a recording sheet.

As described above, the correction period is adjusted each time the rotation period of the photoconductor drums changes. Density variation in the sub-scanning direction can thus be stably suppressed regardless of the rotation period of the photoconductor drums. As a result, a high quality image can be stably formed on a recording medium.

The color printer 2000 of the present embodiment described above includes the photoconductor drums 2030, the optical scanning device 2010 (exposure device), the developing devices 2033, and the density detector 2240. The optical scanning device 2010 drives the light sources 2200 to expose the surfaces of the photoconductor drums 2030 and form latent images on the surfaces. The developing devices 2033 develop the latent images. The density detector 2240 is intended to detect density variation of images in the rotation direction (sub-scanning direction) of the photoconductor drums 2030, the images being developed by the developing devices 2033. The optical scanning device 2010 includes the scanning control device 3020 (processing device) which can correct the driving signals for driving the light sources 2200 (the amounts of light emission of the light sources) on the basis of the output signals of the density detector 2240, and adjust the correction period of the correction data (light amount correction data) on the driving signals for the rotation period of the photoconductor drums 2030.

In such a case, even if the period of density variation deviates from the period of the light amount correction data, the correction period of the light amount correction data can be adjusted to correct the deviation. In other words, the light amount correction data does not need to be calculated again to bring the period of the light amount correction data close to that of density variation. This can suppress an increase in calculation time and transfer time.

As a result, density variation of an image in the rotation direction of the photoconductor drums 2030 can be stably suppressed while suppressing a drop in productivity.

The optical scanning device 2010 includes the RAM 3226 which can store the correction data, and the signal processing unit 3225 (adjustment unit) which can adjust the correction period of the correction data stores in the RAM 3226.

In such a case, the data calculation time and the data transfer time can be reduced as compared to a case where the entire light amount correction data is updated. As a result, a drop in productivity can be greatly suppressed.

The color printer 2000 further includes the home position sensors for detecting the rotation period of the photoconductor drums 2030. The signal processing unit 3225 can adjust the correction period of the light amount correction data on the basis of the output signals of the home position sensors. Even if the rotation period of the photoconductor drums 2030 changes, density unevenness of an image in the rotation direction (sub-scanning direction) of the photoconductor drums 2030 can thus be suppressed.

If the rotation period of a photoconductor drum 2030 changes, the signal processing unit 3225 makes the correction period of the light amount correction data substantially coincident with the length of the changed rotation period. The signal processing unit 3225 can thus make the period of the light amount correction data and that of density variation substantially the same, and can suppress the density variation with higher reliability.

If the correction period is increased, the signal processing unit 3225 expands the correction values which are normally stored as values in units of, e.g., four scans over the increased number of scans, e.g., five scans as many times as the increase in the number of scans. The signal processing unit 3225 can thus increase the correction period while minimizing an increase in the data amount of the adjustment data. As a result, the calculation time and transfer time of the adjustment data can be reduced.

If the correction period is increased, the signal processing unit 3225 expands the correction values which are normally stored as values in units of, e.g., four scans over the increased number of scans, e.g., five scans in a regular manner (for example, periodically or at substantially equal intervals) as many times as the increase in the number of scans. The waveform of the light amount correction data can thus be made approximate to the periodic waveform (sine wave) of density variation. It should be noted that if the correction values stored as values in units of four scans are locally expanded over five scans, a discrepancy of the waveform of the light amount correction data from the periodic waveform of density variation may increase to hinder the suppression of the density variation.

If the correction period is reduced, the signal processing unit 3225 expands the correction values which are normally stored as values in units of, e.g., four scans over the reduced number of scans, e.g., three scans as many time as the decrease in the number of scans. The single processing unit 3225 can thus reduce the correction period while minimizing an increase in the data amount of the adjustment data. As a result, the calculation time and transfer time of the adjustment data can be reduced.

If the correction period is reduced, the signal processing unit 3225 expands the correction values which are normally stored as values in units of, e.g., four scans over the reduced number of scans, e.g., three scans as many times as the decrease in the number of scans. The waveform of the light amount correction data can thus be made approximate to the periodic waveform (sine wave) of density variation. It should be noted that if the correction values stored as values in units of four scans are locally expanded over three scans, a discrepancy of the waveform of the light amount correction data from the periodic waveform of density variation may increase to hinder the suppression of the density variation.

The exposure device is the optical scanning device 2010 which scans the surfaces of the photoconductor drums 2030 by the light from the light sources 2200. The light sources 2200 each include a surface emitting laser array.

In such a case, the surfaces of the photoconductor drums 2030 can be scanned by a plurality of beams of light at high density and at high speed for improved productivity. For example, the number of light emitting units to be turned on can be changed as appropriate according to a change in the linear speed of the photoconductor drums 2030. This facilitates the adjustment of the productivity.

An image forming method according to the present embodiment includes the steps of: driving a light source to expose the surface of a photoconductor drum 2030 and form a latent image on the surface; developing the latent image; detecting density variation of an image in the rotation direction (sub-scanning direction) of the photoconductor drum 2030, the image being developed in the step of developing; correcting the driving signal (the amount of light emission of the light source) on the basis of a detection result in the step of detecting the density variation; storing the correction data (light amount correction data) on the driving signal for a rotation period of the photoconductor drum 2030 (storing the correction data into the RAM 3226 (storage unit)); and adjusting the correction period of the correction data.

In such a case, even if the period of density variation deviates from the period of the light amount correction data, the correction period of the light amount correction data can be adjusted to correct the deviation. In other words, the light amount correction data does not need to be calculated again to bring the period of the light amount correction data close to that of the density variation. This can suppress an increase in calculation time and transfer time.

As a result, density unevenness of the image in the rotation direction of the photoconductor drum can be stably suppressed while suppressing a drop in productivity.

The image forming method according to the present embodiment further includes the step of detecting the rotation period of the photoconductor drum 2030. In the step of adjusting the correction period, the correction period is adjusted on the basis of a detection result in the step of detecting the rotation period. Even if the rotation period of the photoconductor drum 2030 changes, density unevenness of the image in the rotation direction (sub-scanning direction) of the photoconductor drum 2030 can thus be suppressed.

The correction period substantially coincides with the length of the rotation period of the photoconductor drum 2030. In the step of adjusting the correction period, if the rotation period changes, the correction period is made substantially coincident with the length of the changed rotation period. Since the period of the light amount correction data and that of density variation can be made substantially the same, the density variation can be suppressed with higher reliability.

The image forming method according to the present embodiment may further include the step of changing the rotation period of each photoconductor drum. This enables the adjustment of productivity. The rotation period may be changed by a user or a serviceperson via the operation unit. The CPU 3210 may change the rotation period in consideration of processing load in a step or steps downstream of the latent image formation step. For example, if the processing load in a step downstream of the latent image formation step is high, the CPU 3210 may increase the rotation period to increase the time needed for latent image formation. This can suppress a drop in productivity. Changing the rotation period of a photoconductor drum is equivalent to changing the rotation speed (linear speed) of the photoconductor drum.

In the foregoing embodiment, the correction period adjustment processing 1 is performed when the rotation period of a photoconductor drum changes. However, like modification 1 to be described below, correction period adjustment processing 2 may be performed when the number of light emitting units to be turned on is changed for productivity adjustment.

In modification 1, for example, the light sources each include a 32-channel (32-light emitting unit) surface emitting laser array. The light sources can select any one of first, second, third, and fourth light emission modes in which the number of light emitting units to be turned on is 32, 28, 24, and 20, respectively.

The number of light emitting units to be turned on is the number of scanning lines per scan. The smaller the number of light emitting units to be turned on, the longer the time (hereinafter, referred to as latent image formation time) needed to scan one round of the photoconductor drum. In other words, the latent image formation time satisfies the relationship of the first light emission mode<the second light emission mode<the third light emission mode<the fourth light emission mode. As the number of scanning lines per scan decreases, the number of scans increases and, consequently, the latent image formation time increases. Specifically, in the first light emission mode using 32 channels, 96 scanning lines can be formed by three scans. In the third light emission mode using 24 channels, four scans are needed to form 96 scanning lines (see FIG. 21).

To manufacture surface emitting laser array chips with different numbers of light emitting units depending on the specifications of apparatuses (color printers) is costly. Setting the foregoing light emission modes is reasonable even in terms of mass-producing chips with the same number of light emitting units and mounting the chips on apparatuses of various specifications.

The light emission modes are selected to adjust the time needed for the latent image formation step in consideration of the processing load (processing speed) in a step or steps downstream of the latent image formation step. Specifically, for example, the higher the processing load in the downstream steps is, like during thick paper printing and the like, the longer the latent image formation time can be made.

For example, any one of the first to fourth light emission modes (such as the first light emission mode) is initially set according to the specifications and the like of the apparatus at the time of manufacturing of the apparatus. When the apparatus is used, the CPU 3210 appropriately selects a light emission mode according to the operating state of the apparatus.

The light emission modes may be selected, for example, by the user or serviceperson via the operation unit according to the operating state of the apparatus. When any one of the first to fourth light emission modes is selected via the operation unit, its selection signal is output to the CPU 3210.

Figure 22:
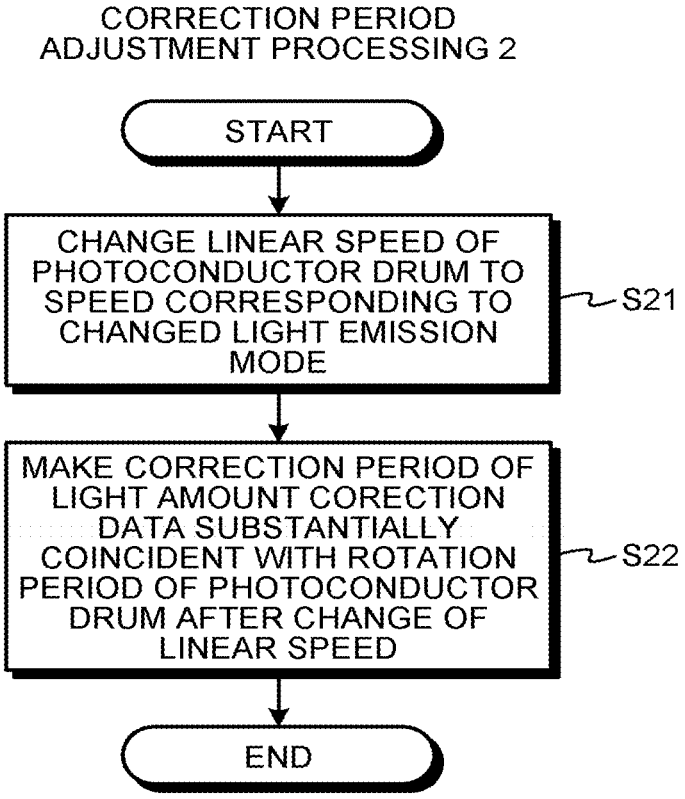
FIG. 22 is a flow chart for describing correction period adjustment processing 2.

The correction period adjustment processing 2 according to modification 1 will be described below with reference to FIG. 22. The flow chart of FIG. 22 corresponds to a processing algorithm to be executed by the signal processing unit 3225. The correction period adjustment processing 2 is started after the light amount correction data acquisition processing is performed in the first light emission mode. The correction period adjustment processing 2 is started station by station when the light emission mode is changed.

The light emission mode is initially set to the first light emission mode. The time needed to scan each photoconductor drum for one round in the first light emission mode (the period of the light amount correction data) and the rotation period of the photoconductor drum are substantially the same. The signal processing unit 3225 can change the linear speed of each photoconductor drum via the driving system of the photoconductor drum. The correction period adjustment processing 2 is performed on each station similarly. Here, the K station will be described in a representative manner.

In the first step S21, the linear speed (rotation speed) of the photoconductor drum 2030*a* is changed to a speed corresponding to the changed light emission mode. Specifically, the linear speed of the photoconductor drum 2030*a* is changed to such a speed that the rotation period of the photoconductor drum 2030*a* substantially coincides with the time needed to scan the photoconductor drum 2030*a* for one round in the changed light emission mode. Here, the light emission mode is changed from the initially-set first light emission mode to one in which the latent image formation time is longer. The linear speed of the photoconductor drum 2030*a* is then reduced accordingly, and the rotation period (the period of density variation) becomes longer.

In the next step S22, the correction period of the light amount correction data is made substantially coincident with the rotation period of the photoconductor drum 2030*a* after the change of the linear speed.

Since the rotation period of the photoconductor drum 2030*a* (the period of density variation) becomes longer, the correction period of the light amount correction data obtained from the photoconductor drum in the first light emission mode can be increased by the same method as in the foregoing embodiment. That is, the correction period of the light amount correction data obtained in the first light emission mode can be increased according to the changed N-th light emission mode (N=2 to 4). Specifically, like the foregoing embodiment, the correction values which are normally stored as values in units of four scans can be expanded over five scans as many times as the increase in the number of scans.

In the next correction period adjustment processing 2, the N-th light emission mode (N=2 to 4) changed this time is used as the initially-set light emission mode. If the light emission mode is changed from the initially-set light emission mode to one in which the latent image formation time is shorter, the correction period of the light amount correction data obtained in the initially-set light emission mode can be reduced by the same method as in the foregoing embodiment.

Figure 21:
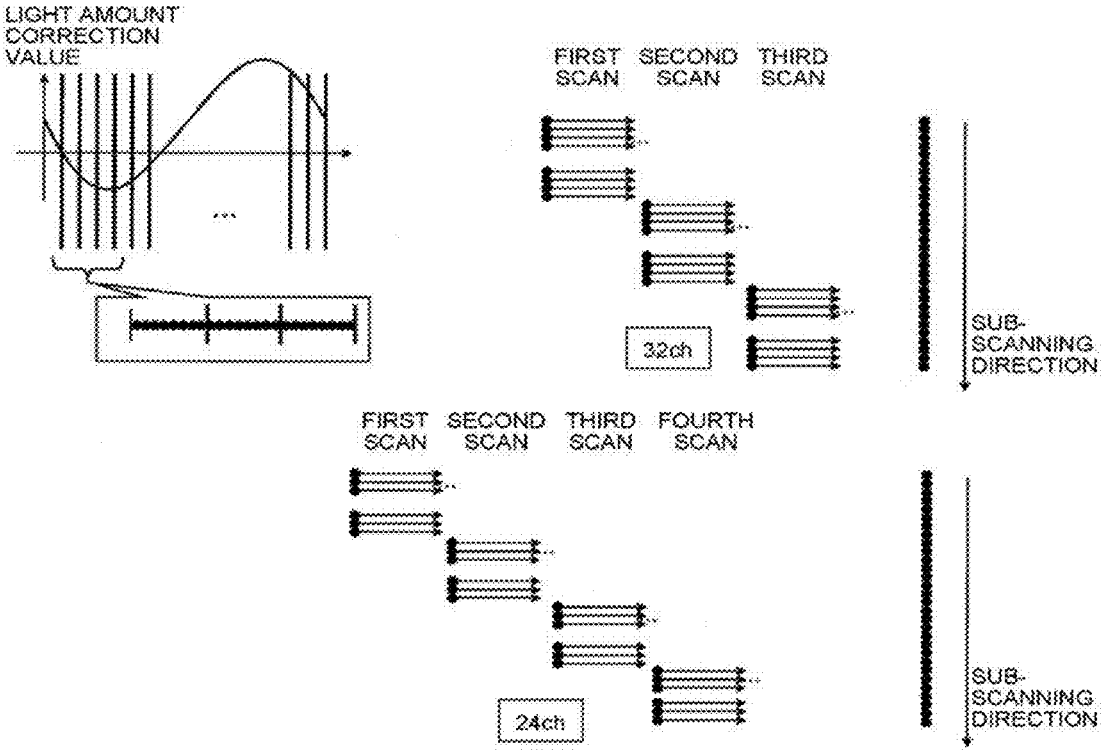
FIG. 21 is a diagram for describing a relationship between the number of light emitting units to be turned on and the number of scans.

After the correction period adjustment processing 2 illustrated in the flow chart of FIG. 21 is performed as described above, image data is input from the host apparatus to the interface unit 3022 via the communication control device 2080 and the printer control device 2090. The image processing unit 3023 applies predetermined processing to the image data, and transmits the resulting image data to the driving control unit 3024.

The modulation signal generation unit 3222 generates the modulation signals (driving signals) of the respective colors according to the image data on the basis of the pixel clock signal from the pixel clock generation unit 3223. The modulation signal generation unit 3222 transmits the modulation signals to the light source driving unit 3224.

The light source driving unit 3224 superimposes the correction period-adjusted light amount correction data for the modulation signals of the respective colors to correct the modulation signals, and outputs the corrected modulation signals to the respective light sources.

The surfaces of the rotating photoconductor drums 2030 are scanned in the main scanning direction by the light emitted from the respective corresponding light sources driven by the corrected modulation signals.

As a result, toner images whose density variation in the sub-scanning direction are suppressed are formed on the surfaces of the photoconductor drums, and eventually a high quality image is formed on a recording sheet.

Now, if the characteristics (surface state) of a photoconductor drum or the characteristics of a light source changes over time, the light amount correction data stored in the RAM 3226 may become unable to sufficiently suppress density variation.

For example, if the correction effect of the amount of light emission of a light source on image density changes, the light amount correction data is desirably fine-adjusted according to the change. In such a case, the light amount correction data may be updated. This, however, results in long recalculation time and transfer time of the light amount correction data as described above, with a drop in productivity.

In modification 2, light amount correction strength adjustment processing is then performed to suppress density variation of an image in the sub-scanning direction while suppressing a drop in productivity.

The light amount correction strength adjustment processing will be described below with reference to FIG. 23. The flow chart of FIG. 23 corresponds to a processing algorithm to be executed by the signal processing unit 3225. The light amount correction strength adjustment processing is performed station by station after a lapse of predetermined time since the light amount correction data acquisition processing is performed.

In the first step S31, the light source 2200 is driven by using the light amount correction data to form a density variation measurement pattern on the transfer belt 2040. Specifically, the light amount correction data is superimposed on the modulation signal (driving signal) for driving the light source 2200, and the processing in the same manner as in step S1 of FIG. 9 is performed.

In the next step S32, output variation of the optical sensors 2245 is obtained. Specifically, the processing in the same manner as in step S2 of FIG. 9 is performed.

In the next step S33, the output variation of the optical sensors 2245 is approximated by a sine wave. Specifically, the processing in the same manner as in step S3 of FIG. 9 is performed.

In the next step S34, whether the output variation of the optical sensors 2245 fall within a predetermined range is determined. Specifically, whether peaks of the output variation are smaller than or equal to a predetermined value is determined. If yes in step S34, the procedure ends. On the other hand, if no in step S34, the processing proceeds to step S35.

In step S35, a light amount correction strength of the light amount correction data is adjusted to suppress the output variation of the optical sensors. In other words, a magnification adjustment (amplitude adjustment) is performed on the light amount correction data.

Specifically, on the basis of the light amount correction data (difference values from the previous scan) stored in the RAM 3226, a correction value (light amount correction strength) of the light amount correction data is increased or decreased from the previous scan as much as a magnification needed for correction according to the output variation, without rewriting the values of the RAM 3226.

Figure 24:
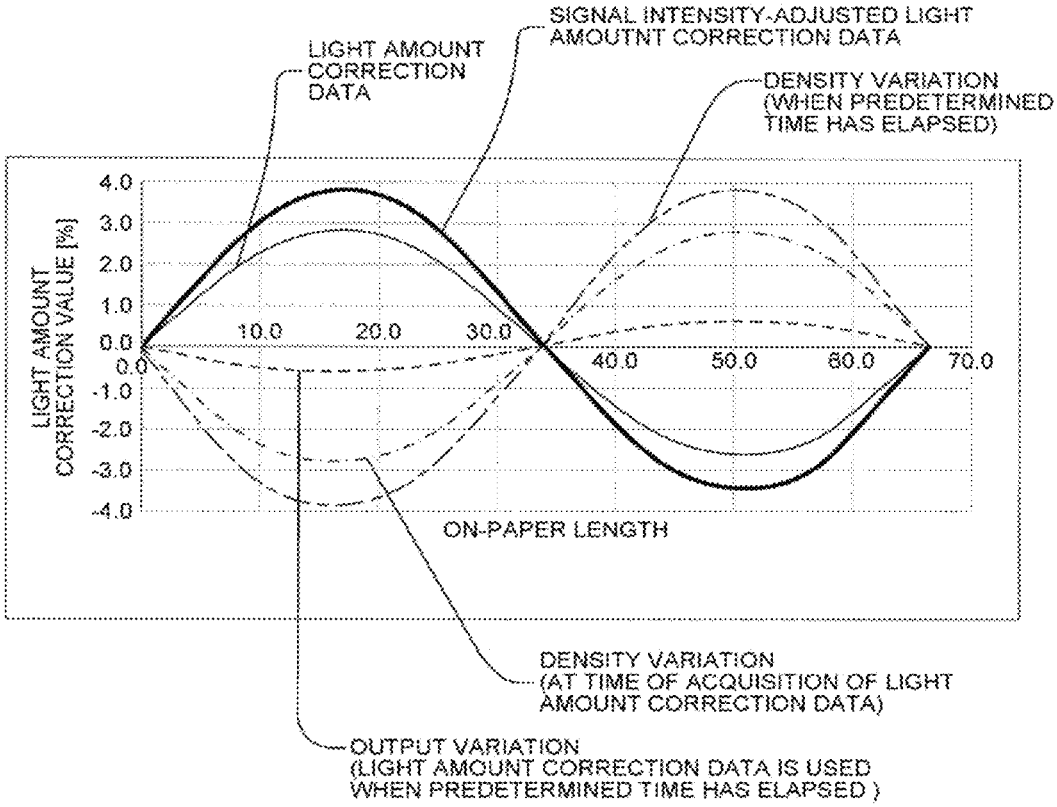
FIG. 24 is a diagram (part 1) for describing the light amount correction strength adjustment processing.

For example, as illustrated in FIG. 24, density variation may remain even after the use of the light amount correction data, or equivalently, the correction of the density variation by the light amount correction data may become insufficient because density variation increases after a lapse of predetermined time from when the light amount correction data is obtained. In such a case, the signal processing unit 3225 increases the light amount correction strength (see FIG. 25).

Figure 26:
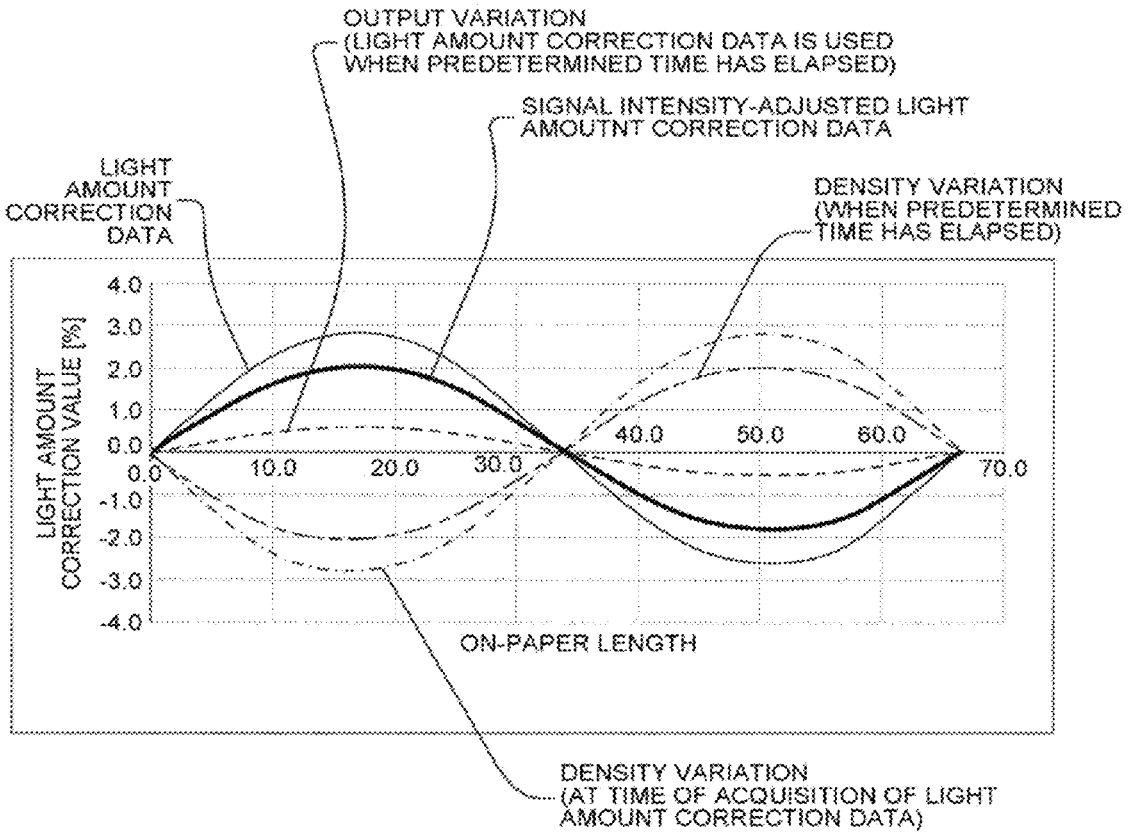
FIG. 26 is a diagram (part 3) for describing the light amount correction strength adjustment processing.

For example, as illustrated in FIG. 26, if density variation decreases after a lapse of predetermined time from when the light amount correction data is obtained, and the correction of the density variation by the light amount correction data becomes excessive, the signal processing unit 3225 decreases the light amount correction strength (see FIG. 27).

Figure 23:
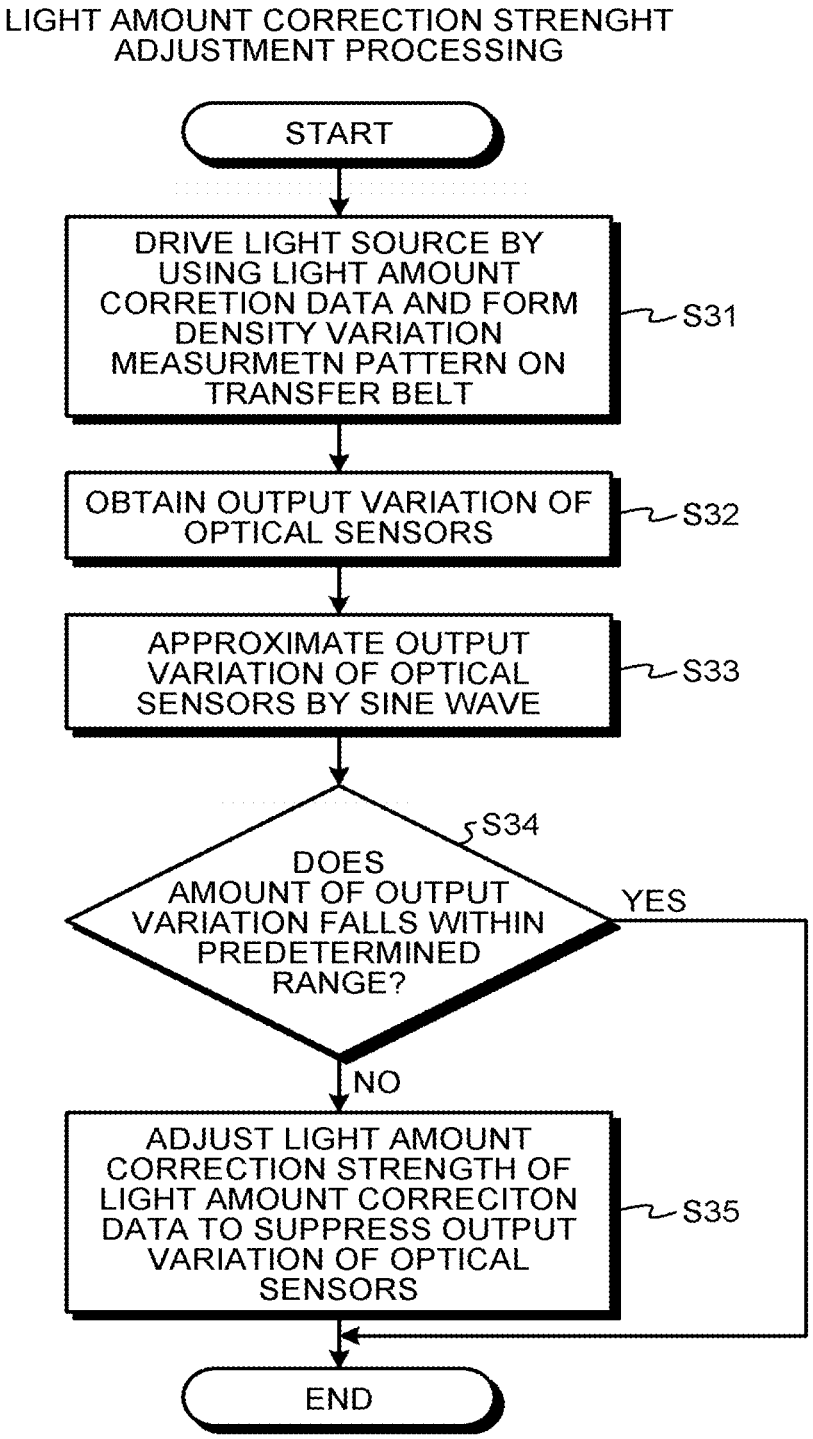
FIG. 23 is a flow chart for describing light amount correction strength adjustment processing.

After the light amount correction strength adjustment processing illustrated in the flow chart of FIG. 23 is performed as described above, image data is input from the host apparatus to the interface unit 3022 via the communication control device 2080 and the printer control device 2090. The image processing unit 3023 applies predetermined processing to the image data, and transmits the resulting image data to the driving control unit 3024.

The modulation signal generation unit 3222 generates the modulation signals (driving signals) of the respective colors according to the image data on the basis of the pixel clock signal from the pixel clock generation unit 3223. The modulation signal generation unit 3222 transmits the modulation signals to the light source driving unit 3224.

Here, the signal processing unit 3225 reads the light amount correction data for each station from the RAM 3226, and transmits a light amount correction strength-adjusted light amount correction data signal to the light source driving unit 3224.

The light source driving unit 3224 superimposes the correction period-adjusted light amount correction data for the modulation signals of the respective colors to correct the modulation signals, and outputs the corrected modulation signals to the respective light sources.

The surfaces of the rotating photoconductor drums are scanned in the main scanning direction by the light emitted from the respective corresponding light sources driven by the corrected modulation signals.

As a result, toner images whose density variation in the sub-scanning direction is suppressed are formed on the surfaces of the photoconductor drums, and eventually a high quality image is formed on a recording sheet.

Figure 28:
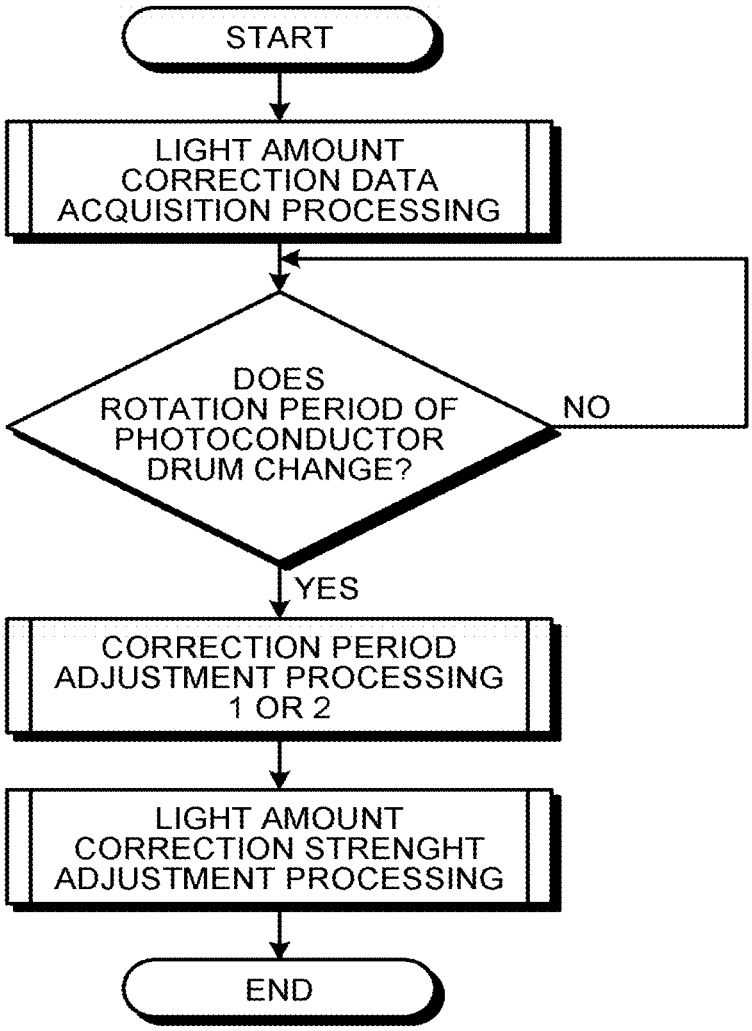
FIG. 28 is a flow chart for performing the light amount correction data acquisition processing, the correction period adjustment processing 1 or 2, and the light amount correction strength adjustment processing.

Like modification 3 illustrated in FIG. 28, after the light amount correction data acquisition processing is performed, the correction period adjustment processing 1 or 2 may be performed if the rotation period of a photoconductor drum 2030 changes. Subsequently, the light amount correction strength adjustment processing may be performed.

In such a case, the waveform of the light amount correction data can be made to follow a change in the waveform of density variation resulting from the change in the rotation period of the photoconductor drum 2030, and a change in the waveform of density variation resulting from changes in the light source characteristics and the surface state of the photoconductor drum 2030 over time. Density variation can thus be stably corrected with high accuracy. Note that as the rotation period of the photoconductor drum 2030 changes, the light source characteristics and the surface state of the photoconductor drum 2030 also change over time.

Figure 29:
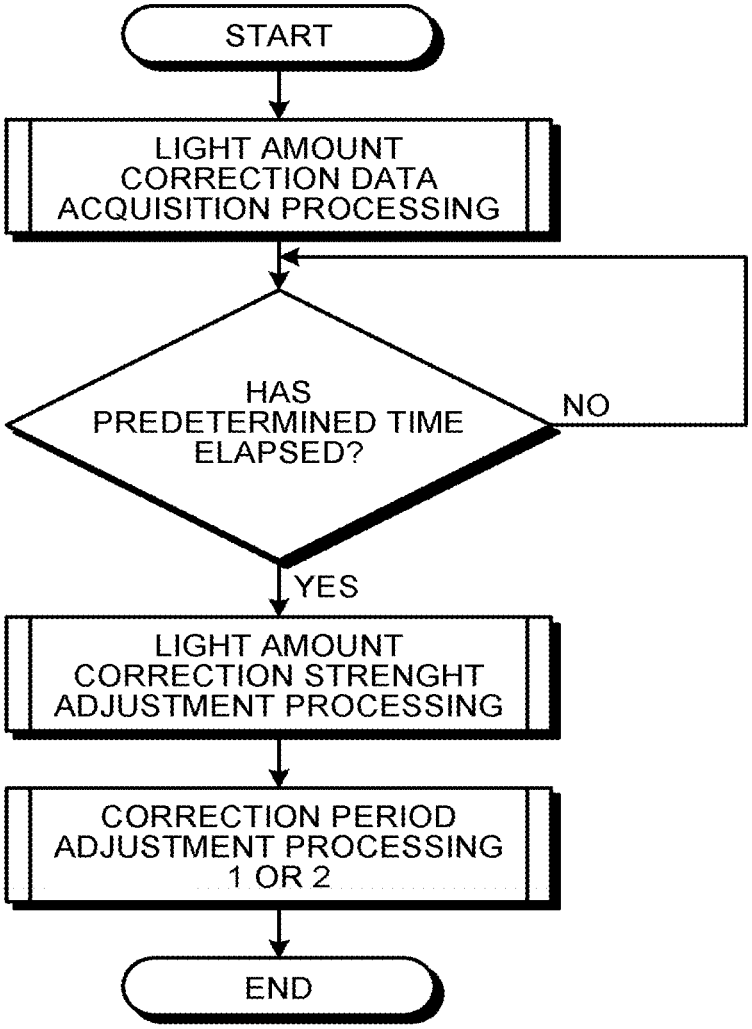
FIG. 29 is a flow chart for performing the light amount correction data acquisition processing, the light amount correction strength adjustment processing, and the correction period adjustment processing 1 or 2.

Like modification 4 illustrated in FIG. 29, after the light amount correction data acquisition processing is performed, the light amount correction strength adjustment processing may be performed if a predetermined time has elapsed. Subsequently, the correction period adjustment processing 1 or 2 may be performed.

In such a case, the waveform of the light amount correction data can be made to follow a change in the waveform of density variation resulting from a change in the rotation period of the photoconductor drum 2030, and a change in the waveform of density variation resulting from changes in the light source characteristics and the surface state of the photoconductor drum 2030 over time. Density variation can thus be stably corrected with high accuracy. If the light source characteristics or the surface state of the photoconductor drum 2030 has changed over time, the rotation period of the photoconductor drum 2030 may change (due to a modification to the rotation period or a deterioration of the driving system of the photoconductor drum).

The foregoing modifications 3 and 4 are not restrictive. In essence, after the light amount correction data acquisition processing, at least either one of the correction period adjustment processing and the light amount correction strength adjustment processing is preferably performed according to need.

The light amount correction data acquisition processing, the correction period adjustment processing 1 and 2, and the light amount correction strength adjustment processing are not limited to those described in the foregoing embodiment and modifications, and may be modified as appropriate. For example, in the foregoing embodiment and modification 1, the correction period of the light amount correction data is made substantially coincident with the changed rotation period. However, this is not restrictive. In essence, the correction period of the light amount correction data can be brought closer to the changed rotation period. For example, correction period adjustment processing (for example, the correction period adjustment processing 1 or 2) may be performed after a lapse of predetermined time from the end of the light amount correction data acquisition processing.

In the foregoing embodiment and modifications, the latent images formed on the photoconductor drums 2030 are transferred to a recording sheet via the transfer belt 2040. However, this is not restrictive. For example, a method for directly transferring the latent images formed on the photoconductor drums 2030 to a recording sheet may be employed. In such a case, a density variation measurement pattern may be formed on a recording sheet, and density variation of the density variation measurement pattern in the sub-scanning direction may be detected by using the optical sensors 2245 to calculate the light amount correction data.

Density variation of the toner images formed (developed) on the surfaces of the photoconductor drums 2030 may be directly detected by using the optical sensors 2245.

The configuration, number, and arrangement of optical sensors in the density detector 2240 are not limited to those described in the foregoing embodiment, and may be modified as appropriate. In essence, the density detector can detect density variation of toner images in the sub-scanning direction.

In the foregoing embodiment and modifications, the RAM 3226 is used as the storage unit. However, this is not restrictive. For example, at least one memory, hard disk, or the like other than a RAM may be used.

The storage unit may be a component of the color printer 2000 serving as the image forming apparatus, not a component of the optical scanning device 2010 serving as the exposure device. The storage unit does not need to be a component of the color printer 2000 serving as the image forming apparatus, either. In other words, the storage unit may be at least one memory, hard disk, or the like externally attached to the image forming apparatus, for example.

In the foregoing embodiment and modifications, the signal processing unit 3225 performs the light amount correction data acquisition processing, the correction period adjustment processing, and the light amount correction strength adjustment processing. However, at least one of such processes may be performed, for example, by the CPU 3210, the printer control device 2090, or an external processing apparatus which is connected to the image forming apparatus (e.g., the color printer 2000).

The configuration of the scanning control device may be modified as appropriate. For example, at least part of the processing performed by the driving control unit may be performed by the image processing unit.

For example, at least part of the processing performed by the image processing unit may be performed by the driving control unit.

For example, at least part of the processing performed by the scanning control device 3020 may be performed by the printer control device 2090. At least part of the processing performed by the printer control device 2090 may be performed by the scanning control device 3020.

In the foregoing embodiment, the optical scanning device is described to be integrally configured. However, this is not restrictive. For example, the image forming stations may be provided with respective optical scanning devices. An optical scanning device may be provided for every two image forming stations.

In the foregoing embodiment and modifications, the light sources include a surface emitting laser. However, this is not restrictive. For example, the light sources may include a light emitting diode (LED), an organic EL device, an edge emitting laser, and other lasers.

In the foregoing embodiment and modifications, the optical scanning device 2010 is employed as the exposure device that irradiates the photoconductor drums 2030 with light based on image data to form latent images. However, this is not restrictive. For example, an optical print head including a line head that includes a plurality of light emitting units arranged apart from each other at least in one axial direction (for example, Y-axis direction) may be employed. The optical print head irradiates the photoconductor drums with a plurality of beams of light modulated on the basis of image data to form latent images. Even in such a case, the light amount correction data acquisition processing, the correction period adjustment processing, and the light amount correction strength adjustment processing can be performed as with the optical scanning device 2010.

In the foregoing embodiment and modifications, the color printer 2000 includes four photoconductor drums. However, this is not restrictive. For example, the color printer 2000 may include five or more photoconductor drums.

In the foregoing embodiment and modifications, the image forming apparatus is described to be the color printer 2000. However, this is not restrictive. For example, the image forming apparatus may be a monochrome printer.

For example, the image forming apparatus may be one that directly irradiates a medium (for example, a sheet) that develops color by laser light with laser light.

The image forming apparatus may be one that uses a silver-halide film as an image bearer. In such a case, a latent image is formed on the silver-halide film by optical scanning. The latent image can be visualized by processing equivalent to the development processing of an ordinary silver-halide photographic process. The visualized image can be transferred to photographic paper by processing equivalent to the printing processing of an ordinary silver-halide photographic process. Such an image forming apparatus can be implemented as an optical platemaking apparatus or an optical drawing apparatus which draws a CT scan image etc.

The image forming apparatus may be other than a printer. Examples thereof may include a copying machine, a facsimile, and a multifunction peripheral integrating such functions.

According to an embodiment, density unevenness of an image in the rotation direction of the photoconductor drum can be stably suppressed while suppressing a drop in productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a photoconductor drum;

an optical scanning device that drives a light source to scan a surface of the photoconductor drum and form a latent image on the surface;

a developing device that develops the latent image; and a density detector to detect density variation of an image in a rotation direction of the photoconductor drum, the image being developed by the developing device, the optical scanning device including a processing device that is configured to correct a driving signal for driving the light source based on an output signal of the density detector to adjust at least either one of a correction period and a correction strength of correction data for the driving signal for a rotation period of the photoconductor drum, wherein the processing device includes a memory storing the correction data; and signal processing circuitry configured to correct the driving signal for driving the light source by adjusting at least either one of the correction period and the correction strength of the correction data stored in the memory based on an output signal of the density detector when the light source is driven using the correction data.

2. The image forming apparatus according to claim 1, further comprising a sensor that detects the rotation period of the photoconductor drum, wherein the signal processing circuitry is further configured to adjust the correction period based on an output signal of the sensor.

3. The image forming apparatus according to claim 2, wherein:

the correction period substantially coincides with a length of the rotation period; and when the rotation period changes, the signal processing circuitry makes the correction period substantially coincident with a length of the changed rotation period.

4. The image forming apparatus according to claim 1, wherein the correction data is stored in the memory as correction values in units of a plurality of scans.

5. The image forming apparatus according to claim 4, wherein if the correction period is increased, the correction values, when expanded for each scan, are expanded while the number of scans is increased by at least one at random.

6. The image forming apparatus according to claim 4, wherein if the correction period is increased, the correction values, when expanded for each scan, are expanded while the number of scans is increased by at least one in a regular manner.

7. The image forming apparatus according to claim 4, wherein if the correction period is reduced, the correction values, when expanded for each scan, are expanded while the number of scans is reduced by at least one at random.

8. The image forming apparatus according to claim 4, wherein if the correction period is reduced, the correction values, when expanded for each scan, are expanded while the number of scans is reduced by at least one in a regular manner.

9. The image forming apparatus according to claim 1, wherein the light source includes a surface emitting laser array.

10. An image forming method, comprising:

driving a light source to expose a surface of a photoconductor drum and form a latent image on the surface;

developing the latent image;

detecting density variation of an image in a rotation direction of the photoconductor drum, the image being developed at the developing;

correcting a driving signal on a basis of a detection result at the detecting of the density variation;

storing correction data for the driving signal for a rotation period of the photoconductor drum; and adjusting at least either one of a correction period and a correction strength of the correction data, wherein the method further comprises detecting the rotation period of the photoconductor drum, and in the adjusting, the correction period is adjusted based on a result of detection in the step of detecting the rotational period.

11. The image forming method according to claim 10, wherein:

the correction period substantially coincides with a length of the rotation period; and in the adjusting, if the rotation period changes, the correction period is made substantially coincident with a length of the changed rotation period.

12. The image forming method according to claim 10, wherein in the adjusting, if the density variation detected when the light source is driven by using the correction data exceeds a predetermined range, the correction strength is adjusted.

13. An image forming method, comprising:

driving a light source to expose a surface of a photoconductor drum and form a latent image on the surface;

developing the latent image;

detecting density variation of an image in a rotation direction of the photoconductor drum, the image being developed at the developing;

correcting a driving signal on a basis of a detection result at the detecting of the density variation;

storing correction data for the driving signal for a rotation period of the photoconductor drum; and adjusting at least either one of a correction period and a correction strength of the correction data, wherein the method further comprises changing the rotation period of the photoconductor drum.

14. The image forming method according to claim 13, wherein:

the light source includes a plurality of light emitting units arranged apart from each other at least in a direction corresponding to the rotation direction;

the image forming method further comprises changing the number of light emitting units to be turned on among the plurality of light emitting units; and in the changing of the rotation period, the rotation period is changed according to the changed number of light emitting units.

15. An image forming apparatus for driving a light source to expose a photoconductor drum and form an image, the image forming apparatus comprising:

a density detector to detect density variation of the image in a rotation direction of the photoconductor drum; and a processing device configured to correct a driving signal for driving the light source based on an output signal of the density detector to adjust at least either one of a correction period and a correction strength of correction data for a rotation period of the photoconductor drum, wherein the processing device includes a memory storing the correction data; and signal processing circuitry configured to correct the driving signal for driving the light source by adjusting at least either one of the correction period and the correction strength of the correction data stored in the memory based on an output signal of the density detector when the light source is driven using the correction data.

16. An image forming apparatus, comprising:

a photoconductor drum;

an optical scanning device that drives a light source to scan a surface of the photoconductor drum and form a latent image on the surface;

a developing device that develops the latent image;

a density detector to detect density variation of an image in a rotation direction of the photoconductor drum, the image being developed by the developing device; and a sensor that detects a rotation period of the photoconductor drum, the optical scanning device including a processing device configured to correct a driving signal for driving the light source based on an output signal of the density detector to adjust at least either one of a correction period and a correction strength of correction data for the driving signal for a rotation period of the photoconductor drum, wherein the processing device includes a memory storing the correction data, and signal processing circuitry configured to correct the driving signal for driving the light source by adjusting at least either one of the correction period and the correction strength of the correction data stored in the memory based on an output signal of the sensor that detects the rotation period of the photoconductor drum.

* * * * *